US007703298B2

(12) United States Patent
Lee et al.

(10) Patent No.: US 7,703,298 B2
(45) Date of Patent: Apr. 27, 2010

(54) REFRIGERATOR WITH ICEMAKER

(75) Inventors: Myung Ryul Lee, Sungnam-si (KR); Seong Jae Kim, Ansan-si (KR); Chang Ho Seo, Seoul (KR); Sung Hoon Chung, Seoul (KR)

(73) Assignee: LG Electronics Inc., Seoul (KR)

( * ) Notice: Subject to any disclaimer, the term of this patent is extended or adjusted under 35 U.S.C. 154(b) by 27 days.

(21) Appl. No.: 12/104,268

(22) Filed: Apr. 16, 2008

(65) Prior Publication Data

US 2008/0209938 A1 Sep. 4, 2008

Related U.S. Application Data

(63) Continuation of application No. 11/739,291, filed on Apr. 24, 2007, now Pat. No. 7,392,665, and a continuation of application No. 11/402,818, filed on Apr. 13, 2006, now Pat. No. 7,222,498, and a continuation of application No. 10/769,814, filed on Feb. 3, 2004, now Pat. No. 7,076,967.

(30) Foreign Application Priority Data

Sep. 19, 2003 (KR) ..... 10-2003-0065163

(51) Int. Cl.
*F25C 5/14* (2006.01)

(52) U.S. Cl. ..... 62/344; 62/419

(58) Field of Classification Search ..... 62/340–356, 62/417, 419, 426

See application file for complete search history.

(56) References Cited

U.S. PATENT DOCUMENTS

| | | | |
|---|---|---|---|
| 1,017,197 | A | 2/1912 | Barnes |
| 1,064,314 | A | 6/1913 | German |
| 1,377,411 | A | 5/1921 | Douglas |
| 1,377,455 | A | 5/1921 | Beidler |
| 1,604,621 | A | 10/1926 | Wallace |
| 2,139,441 | A | 12/1938 | Clarke |
| 2,223,947 | A | 12/1940 | Blood |
| 2,256,551 | A | 9/1941 | Colvin |

(Continued)

FOREIGN PATENT DOCUMENTS

| | | |
|---|---|---|
| AU | 2002300161 | 11/2004 |

(Continued)

OTHER PUBLICATIONS

Office Action issued by the Indian Patent Office, dated Jun. 15, 2007, 2 pages.

(Continued)

*Primary Examiner*—William E Tapolcai
(74) *Attorney, Agent, or Firm*—Fish & Richardson P.C.

(57) ABSTRACT

Refrigerator with an icemaker including a cabinet having a mullion wall for compartmentalization of a freezing chamber and a refrigerating chamber, a case provided to a door on the refrigerating chamber, having a cavity therein, a first duct for supplying cold air from a neighborhood of an evaporator in the freezing chamber to the cavity, the icemaker in the cavity for producing ice, an ice container in the cavity for storing the ice, and a dispenser in the door in communication with the cavity, thereby having ice supplied to a user at an outside of the refrigerator through a dispenser provided to the door.

49 Claims, 10 Drawing Sheets

U.S. PATENT DOCUMENTS

| | | | | | |
|---|---|---|---|---|---|
| 2,400,634 | A | | 5/1946 | Earle | |
| 2,410,334 | A | | 10/1946 | Brace | |
| 2,493,488 | A | | 1/1950 | Jordan | |
| 2,544,394 | A | | 3/1951 | Muffly | |
| 2,605,621 | A | | 8/1952 | Kellershon | |
| 2,712,733 | A | | 7/1955 | King | |
| 2,717,505 | A | | 9/1955 | Andersson | |
| 2,724,242 | A | * | 11/1955 | Pulaski | 62/283 |
| 2,728,203 | A | * | 12/1955 | King | 62/377 |
| 2,765,633 | A | | 10/1956 | Muffly | |
| 2,774,224 | A | | 12/1956 | Bayston | |
| 2,779,165 | A | | 1/1957 | Pichler | |
| 2,795,117 | A | | 6/1957 | Herndon, Jr. | |
| 2,894,378 | A | * | 7/1959 | Saunders et al. | 62/337 |
| 2,907,180 | A | | 10/1959 | Mann | |
| 3,025,679 | A | | 3/1962 | Keighley | |
| 3,100,970 | A | | 8/1963 | Elfving | |
| 3,122,005 | A | | 2/1964 | Constantini | |
| 3,126,714 | A | | 3/1964 | Zuercher, Jr. | |
| 3,146,601 | A | | 9/1964 | Gould | |
| 3,146,606 | A | | 9/1964 | Grimes | |
| 3,151,472 | A | | 10/1964 | Harle | |
| 3,182,464 | A | | 5/1965 | Archer | |
| 3,192,726 | A | | 7/1965 | Newton | |
| 3,225,559 | A | | 12/1965 | Fischer | |
| 3,226,939 | A | | 1/1966 | Harbison | |
| 3,270,519 | A | | 9/1966 | Pohl, Jr. | |
| 3,308,631 | A | | 3/1967 | Kniffin | |
| 3,350,899 | A | | 11/1967 | Jones | |
| 3,359,751 | A | | 12/1967 | Stevens | |
| 3,364,694 | A | | 1/1968 | Cohen | |
| 3,382,682 | A | | 5/1968 | Frohbieter | |
| 3,440,308 | A | | 4/1969 | Carbary | |
| 3,541,806 | A | | 11/1970 | Jacobs | |
| 3,561,231 | A | | 2/1971 | Webb | |
| 3,568,465 | A | | 3/1971 | Jung | |
| 3,572,049 | A | | 3/1971 | Moorman | |
| 3,581,516 | A | | 6/1971 | Buchser | |
| 3,602,007 | A | | 8/1971 | Drieci | |
| 3,633,374 | A | | 1/1972 | Canter | |
| 3,640,088 | A | | 2/1972 | Jacobus | |
| 3,654,772 | A | | 4/1972 | Curry, III | |
| 3,745,779 | A | | 7/1973 | Bright | |
| 3,747,363 | A | | 7/1973 | Grimm | |
| 3,775,994 | A | | 12/1973 | Linstromberg | |
| 3,788,089 | A | | 1/1974 | Graves | |
| 3,789,620 | A | | 2/1974 | Benasutti | |
| 3,821,881 | A | | 7/1974 | Harkias | |
| 3,834,177 | A | | 9/1974 | Scarlett | |
| 3,850,008 | A | | 11/1974 | Frazier | |
| 3,866,434 | A | | 2/1975 | Pugh | |
| 3,889,888 | A | | 6/1975 | Prada | |
| 3,902,331 | A | | 9/1975 | True, Jr. | |
| 3,972,204 | A | | 8/1976 | Sidorenko | |
| 4,003,214 | A | | 1/1977 | Schumacher | |
| 4,007,600 | A | | 2/1977 | Simms | |
| 4,020,644 | A | | 5/1977 | True, Jr. | |
| 4,084,725 | A | | 4/1978 | Buchser | |
| 4,087,140 | A | | 5/1978 | Linstromberg | |
| 4,100,761 | A | | 7/1978 | Linstromberg | |
| 4,118,451 | A | | 10/1978 | Schaus | |
| 4,142,373 | A | | 3/1979 | Weibel, Jr. | |
| 4,142,377 | A | | 3/1979 | Fogt | |
| 4,142,378 | A | | 3/1979 | Bright | |
| 4,223,538 | A | | 9/1980 | Braden | |
| 4,227,383 | A | | 10/1980 | Horvay | |
| 4,250,923 | A | | 2/1981 | Johnson | |
| 4,280,682 | A | | 7/1981 | Zukausky | |
| 4,285,212 | A | | 8/1981 | Prada | |
| 4,306,757 | A | | 12/1981 | Horvay | |
| 4,332,146 | A | | 6/1982 | Yamazaki | |
| 4,333,588 | A | | 6/1982 | Schreck | |
| 4,368,622 | A | * | 1/1983 | Brooks | 62/157 |
| 4,487,024 | A | | 12/1984 | Fletcher | |
| 4,543,800 | A | | 10/1985 | Mawby | |
| 4,586,347 | A | * | 5/1986 | McCarty | 62/265 |
| 4,587,810 | A | | 5/1986 | Fletcher | |
| 4,614,088 | A | | 9/1986 | Brooks | |
| 4,644,753 | A | | 2/1987 | Burke | |
| 4,727,720 | A | | 3/1988 | Wernicki | |
| 4,732,009 | A | | 3/1988 | Frohbieter | |
| 4,754,615 | A | | 7/1988 | Linstromberg | |
| 4,756,165 | A | | 7/1988 | Chestnut | |
| 4,799,362 | A | | 1/1989 | Chestnut | |
| 4,831,840 | A | | 5/1989 | Fletcher | |
| 4,835,978 | A | | 6/1989 | Cole | |
| 4,838,026 | A | | 6/1989 | Searl | |
| 4,872,317 | A | | 10/1989 | Reed | |
| 4,889,316 | A | | 12/1989 | Donahue, Jr. | |
| 4,916,921 | A | | 4/1990 | Fletcher | |
| 4,922,725 | A | | 5/1990 | Rasmussen | |
| 4,961,320 | A | | 10/1990 | Gutmann | |
| 4,970,871 | A | | 11/1990 | Rudick | |
| 4,997,109 | A | | 3/1991 | Carper | |
| 5,010,738 | A | | 4/1991 | Brown | |
| 5,033,636 | A | | 7/1991 | Jenkins | |
| 5,037,004 | A | | 8/1991 | Katz | |
| 5,056,688 | A | | 10/1991 | Goetz | |
| 5,077,985 | A | | 1/1992 | Buchser | |
| 5,090,208 | A | | 2/1992 | Aono | |
| 5,117,654 | A | | 6/1992 | Steffenhagen | |
| 5,198,244 | A | | 3/1993 | Rice | |
| 5,211,462 | A | | 5/1993 | Bien | |
| 5,212,955 | A | | 5/1993 | Hogan | |
| 5,219,225 | A | | 6/1993 | Ball | |
| 5,261,248 | A | | 11/1993 | Willis | |
| 5,272,888 | A | | 12/1993 | Fisher | |
| 5,273,219 | A | | 12/1993 | Beach, Jr. | |
| 5,310,090 | A | | 5/1994 | Taylor, Jr. | |
| 5,327,856 | A | | 7/1994 | Schroeder | |
| 5,355,686 | A | | 10/1994 | Weiss | |
| 5,357,769 | A | | 10/1994 | Crabtree | |
| 5,375,432 | A | | 12/1994 | Cur | |
| 5,388,427 | A | | 2/1995 | Lee | |
| 5,542,264 | A | | 8/1996 | Hortin | |
| 5,551,252 | A | | 9/1996 | Lee | |
| 5,584,191 | A | * | 12/1996 | Kwon | 62/417 |
| 5,596,182 | A | | 1/1997 | Edwards | |
| 5,642,628 | A | | 7/1997 | Whipple, III | |
| 5,711,159 | A | | 1/1998 | Whipple, III | |
| 5,715,699 | A | | 2/1998 | Coates | |
| 5,729,997 | A | | 3/1998 | Witsoe | |
| 5,758,512 | A | | 6/1998 | Peterson | |
| 5,787,723 | A | | 8/1998 | Mueller | |
| 5,810,331 | A | | 9/1998 | Smock | |
| 5,816,060 | A | | 10/1998 | Brownell | |
| 5,823,001 | A | | 10/1998 | Patrick | |
| 5,826,437 | A | * | 10/1998 | Kim | 62/186 |
| 5,829,263 | A | | 11/1998 | Park | |
| 5,834,126 | A | | 11/1998 | Sheu | |
| 5,846,446 | A | | 12/1998 | Jackson | |
| 5,849,227 | A | | 12/1998 | Chikugo | |
| 5,896,752 | A | * | 4/1999 | Park | 62/186 |
| 5,899,083 | A | | 5/1999 | Peterson | |
| 5,947,342 | A | | 9/1999 | Song | |
| 5,956,967 | A | | 9/1999 | Kim | |
| 5,992,167 | A | | 11/1999 | Hill | |
| 6,019,447 | A | | 2/2000 | Jackovin | |
| 6,050,097 | A | | 4/2000 | Nelson | |
| 6,053,472 | A | | 4/2000 | DeLand | |
| 6,055,826 | A | | 5/2000 | Hiraoka | |
| 6,062,826 | A | | 5/2000 | Morimoto | |
| 6,082,130 | A | | 7/2000 | Pastryk | |
| 6,090,281 | A | | 7/2000 | Buckner | |

| | | | |
|---|---|---|---|
| 6,091,062 | A | 7/2000 | Pfahnl |
| 6,148,620 | A | 11/2000 | Kumagai |
| 6,148,624 | A | 11/2000 | Bishop |
| 6,176,099 | B1 | 1/2001 | Hynes |
| 6,286,324 | B1 | 9/2001 | Pastryk |
| 6,312,608 | B1 | 11/2001 | Buckner |
| 6,314,745 | B1 | 11/2001 | Janke |
| 6,351,955 | B1 | 3/2002 | Oltman |
| 6,351,958 | B1 | 3/2002 | Pastryk |
| 6,351,967 | B1 | 3/2002 | Adachi |
| 6,401,461 | B1 | 6/2002 | Harrison |
| 6,412,286 | B1 | 7/2002 | Park |
| 6,422,031 | B1 | 7/2002 | Mandel |
| 6,425,425 | B2 | 7/2002 | Bianchi |
| 6,438,976 | B2 | 8/2002 | Shapiro |
| 6,438,988 | B1 | 8/2002 | Paskey |
| 6,442,954 | B1 | 9/2002 | Shapiro |
| 6,464,854 | B2 | 10/2002 | Andrews |
| 6,474,094 | B2 | 11/2002 | Kim |
| 6,497,113 | B1 | 12/2002 | Yamada |
| 6,550,268 | B2 | 4/2003 | Lee |
| 6,574,974 | B1 | 6/2003 | Herzog |
| 6,604,377 | B2 | 8/2003 | Watanabe |
| 6,612,116 | B2 | 9/2003 | Fu |
| 6,655,166 | B1 | 12/2003 | Williams |
| 6,694,754 | B1 | 2/2004 | Schenk |
| 6,708,726 | B2 | 3/2004 | Hashimoto |
| 6,725,680 | B1 | 4/2004 | Schenk |
| 6,732,537 | B1 | 5/2004 | Anell |
| 6,735,959 | B1 | 5/2004 | Najewicz |
| 6,742,351 | B2 | 6/2004 | Kim |
| 6,742,353 | B2 | 6/2004 | Ohashi |
| 6,755,166 | B2 | 6/2004 | Chang |
| 6,820,433 | B2 | 11/2004 | Hwang |
| 6,845,631 | B1 | 1/2005 | Hallin |
| 6,880,355 | B2 | 4/2005 | Jung |
| 6,964,177 | B2 | 11/2005 | Lee |
| 7,008,032 | B2 | 3/2006 | Chekal |
| 2001/0025505 | A1 | 10/2001 | Nelson |
| 2002/0121096 | A1 | 9/2002 | Harrison |
| 2002/0124576 | A1 | 9/2002 | Loibl |
| 2003/0010053 | A1 | 1/2003 | Kim |
| 2003/0010056 | A1 | 1/2003 | Sakamoto |
| 2003/0046947 | A1 | 3/2003 | Ohya |
| 2006/0218961 | A1 | 10/2006 | Kim |

FOREIGN PATENT DOCUMENTS

| | | |
|---|---|---|
| CN | 1104608 C | 4/2003 |
| EP | 0 657 706 | 6/1995 |
| EP | 0 715 136 | 6/1996 |
| EP | 1 445 558 | 11/2004 |
| GB | 2 167 544 | 5/1986 |
| GB | 2 242 731 | 10/1991 |
| JP | 50-069644 | 6/1975 |
| JP | 56-113417 | 9/1981 |
| JP | 3-505368 | 11/1991 |
| JP | 04-124570 | 4/1992 |
| JP | 06-011228 | 1/1994 |
| JP | 08-338681 | 12/1996 |
| JP | 09-113116 | 5/1997 |
| JP | 09-196548 | 7/1997 |
| JP | 11-304331 | 11/1999 |
| JP | 2000-009372 | 1/2000 |
| JP | 2000-065458 | 3/2000 |
| JP | 2000-220942 | 8/2000 |
| JP | 2002-228316 | 8/2002 |
| JP | 2003-56966 | 2/2003 |
| KR | 98-83727 | 12/1998 |
| WO | 90-15962 | 12/1990 |
| WO | WO 03/102481 | 12/2003 |

OTHER PUBLICATIONS

USPTO Final Office Action in U.S. Appl. No. 12/133,978, mailed Mar. 10, 2009, 8 pages.

Notice of Allowance issued in U.S. Appl. No. 12/133,978, dated Jun. 5, 2009, 6 pages.

Japanese Office Action issued in Japanese Application No. 2004-020063, mailed Jun. 2, 2009, 3 pages.

* cited by examiner

REFRIGERATOR WITH ICEMAKER

This application is a Continuation of co-pending application Ser. No. 10/769,814, filed on Feb. 3, 2004, the entire contents of which are hereby incorporated by reference and for which priority is claimed under 35 U.S.C. §120.

BACKGROUND OF THE INVENTION

1. Field of the Invention

The present invention relates to refrigerators, and more particularly, to a refrigerator with an icemaker of an improved structure, which can dispense ice pieces from a dispenser provided to a refrigerator door.

2. Background of Related Art

The refrigerator is used for long time fresh storage of food. The refrigerator has food storage chambers each of which temperature is maintained in a low temperature state by a refrigerating cycle, for fresh storage of the food.

There are a plurality of storage chambers of different characteristics, so that the user can select storage methods suitable for storage of various kinds of food, taking kinds and characteristics of food and required storage time periods into account. Of the storage chambers, the refrigerating chamber and the freezing chamber are typical.

The refrigerating chamber is maintained at about 3° C.~4° C. for long time fresh storage of food and vegetable, and the freezing chamber is maintained at a subzero temperature for long time storage of meat and fish in a frozen state, and making and storage of ice pieces. In general, the refrigerating chamber has a volume greater than the freezing chamber, and the freezing chamber is allocated over the refrigerating chamber.

In the meantime, recently, other than the foregoing traditional functions of the refrigerator, the refrigerator has been developed to have a variety of additional functions. For an example, for drinking cold water in the refrigerating chamber, in the related art, the user is required to open the door, and take out a water bottle from the refrigerating chamber.

However, recently, a refrigerator provided with a water dispenser to an outside of a refrigerator door is developed, for dispensing cold water cooled down by cold air in the refrigerating chamber, enabling the user supplied with, and drink the cold water at outside of the refrigerator without opening the door. Moreover, refrigerators each having a water purifying function added to the water dispenser are spread.

In general, the water dispenser is provided to a door on the refrigerating chamber for easy supplied of water from the refrigerating chamber to an outside of the refrigerator. However, since the refrigerating chamber is allocated under the freezing chamber, the water dispenser can not, but be provided at a relatively low position. According to this, for using the water dispenser, the user is required to bend forward.

In the meantime, when the user drinks water, and when the user cooks food, the user uses ice, frequently. For using ice thus, it is required to open the door on the freezing chamber, and separate ice from an ice tray.

Moreover, the opening of the door on the freezing chamber for using the ice causes escaping to cold air from the freezing chamber to an outside of the refrigerator, resulting in temperature rise of the freezing chamber, to required more work of the compressor that consumes an energy.

SUMMARY OF THE INVENTION

Accordingly, the present invention is directed to a refrigerator with an icemaker that substantially obviates one or more of the problems due to limitations and disadvantages of the related art.

An object of the present invention is to provide a refrigerator with an icemaker of an improved structure, in which a dispenser is provided at a height convenient for a user.

Another object of the present invention is to provide a refrigerator with an icemaker of an improved structure, which can dispense ice to a user at an outside of the refrigerator without opening a door.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the refrigerator with an icemaker includes a cabinet, a case, a first duct, the icemaker, an ice container, and a dispenser.

The cabinet includes a mullion wall for compartmentalization of a freezing chamber and a refrigerating chamber. The case is provided to a door on the refrigerating chamber, and has a cavity therein. It is preferable that the case is formed of a thermal insulating material. The first duct provided to pass through the mullion wall for supplying cold air from a neighborhood of an evaporator in the freezing chamber to the cavity. The icemaker is provided in the cavity, and produces ice, and the ice container is provided in the cavity, and stores the ice. The dispenser is provided in the door so as to be in communication with the cavity.

The first duct includes a first part in the door in communication with the cavity, and a second part in the freezing chamber passed through the mullion wall, the second part being in communication with the first part when the door is closed. The first duct further includes a gasket at a connection part of the first and the second parts when the door is closed.

The first duct includes a first part in the door in communication with the cavity, and a second part in contact with the mullion wall, and in communication with the first part passed through the mullion wall.

The first duct includes a first part provided to the door, and a second part provided to a sidewall of the cabinet so as to be in communication with the first part.

The refrigerator may further include a first fan adjacent to the evaporator for supplying cold air to the first duct, and a second fan in a bent part of the first duct for turning a flow direction of the cold air. The case may further include a hole in communication with the refrigerating chamber. The case may further include a damper on the hole.

The second duct has one end arranged adjacent to the evaporator, and the other end arranged in the refrigerating chamber, for supplying the cold air to the refrigerating chamber. The second duct includes a plurality of through holes in an outside circumferential surface for supplying cold air to the refrigerating chamber. The second duct includes a louver provided to each of the through holes for guiding a discharge direction of the cold air.

The refrigerator further includes a damper adjacent to the evaporator for controlling a flow rate of the cold air supplied to the second duct.

In other aspect of the present invention, there is provided a refrigerator with an icemaker including the cabinet, the case, the first duct, a third duct, the icemaker, the ice container, and the dispenser.

The third duct has one end in communication with the cavity, and the other end in communication with the freezing chamber, for supplying the cold air from the cavity to the freezing chamber.

The third duct may include a third part provided to the door so as to be in communication with the cavity, and a fourth part in communication with the freezing chamber passed through the mullion wall, and fitted so as to be in communication with the third part when the door is closed. The third duct may further include a gasket provided to a part where the third part and the fourth part are connected when the door is closed.

The third duct may include a third part provided to the door so as to be in communication with the cavity, and a fourth part provided to the sidewall of the cabinet, and fitted so as to be in communication with the third part when the door is closed.

In another aspect of the present invention, there is provided a refrigerator with an icemaker including the cabinet, the case, the first duct, the second duct, the third duct, the icemaker, the ice container, and the dispenser.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1:
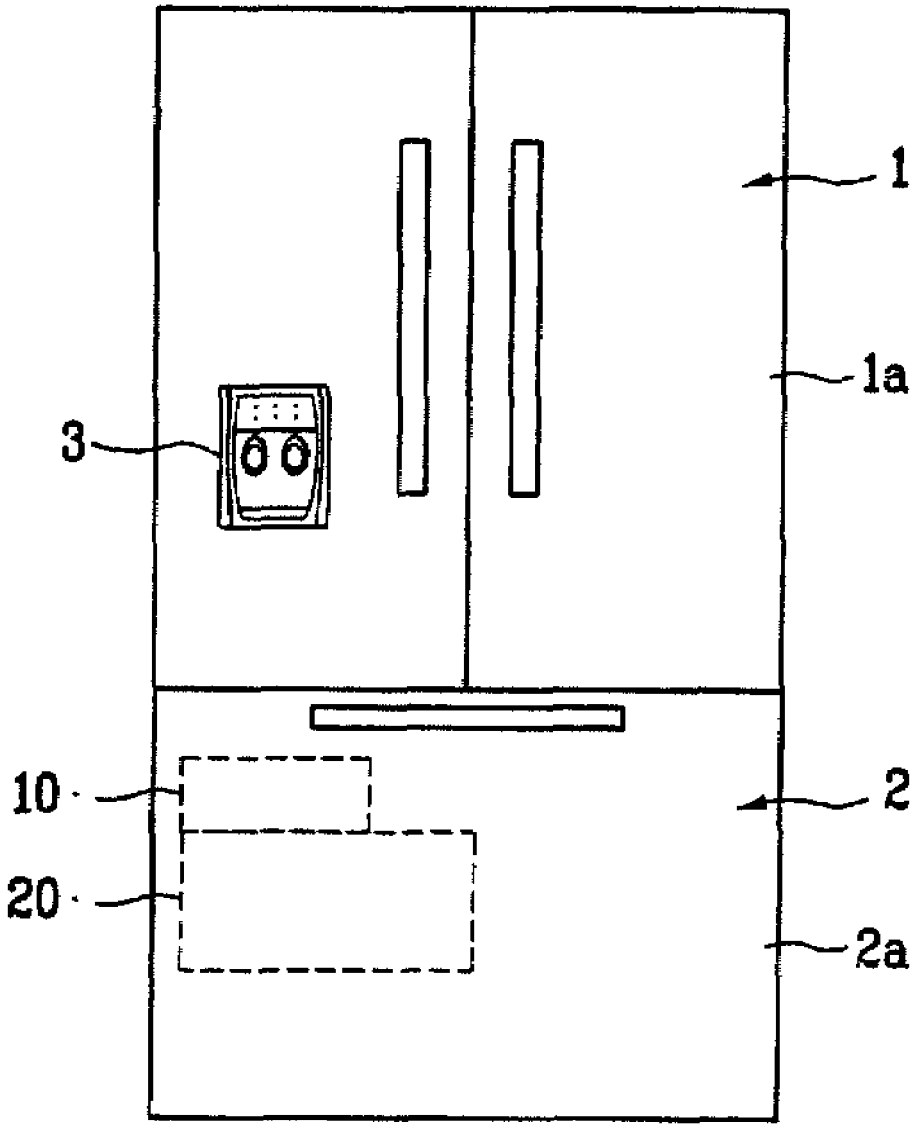
FIG. 1 illustrates a diagram of a refrigerator in accordance with a preferred embodiment of the present invention.

Referring to FIG. 1, though the related art refrigerator has a refrigerating chamber in a lower part thereof and a freezing chamber in an upper part thereof, the refrigerator of the present invention has a freezing chamber 2 in a lower part thereof and a refrigerating chamber 1 in an upper part thereof.

Referring to FIG. 1, the refrigerator of the present invention includes a refrigerating chamber 1 in an upper part of the refrigerator, and a freezing chamber 2 in a lower part of the refrigerator. There is a door 1*a* in a front part of the refrigerating chamber 1, with a water dispenser 3 provided thereto. The water dispenser 3 enables the user to be supplied with cold water directly at an outside of the refrigerator without opening the door 1*a*. For this, there is a water tank (not shown) on an inside surface of the door 1*a* in contact with the refrigerating chamber 1. The water tank stores water, and the water in the water tank is cooled by the cold air in the refrigerating chamber 1. According to this, when the user operates the lever (not shown), the user can be supplied with the cold water from the water tank through the water dispenser 3.

Thus, the refrigerator is the refrigerating chamber 1 positioned in the upper part thereof, and the freezing chamber 2 positioned in the lower part thereof. Therefore, the water dispenser 3 can be provided at a waist or breast height of the user. According to this, the user can use the water dispenser 3 very easily and conveniently.

Figure 3:
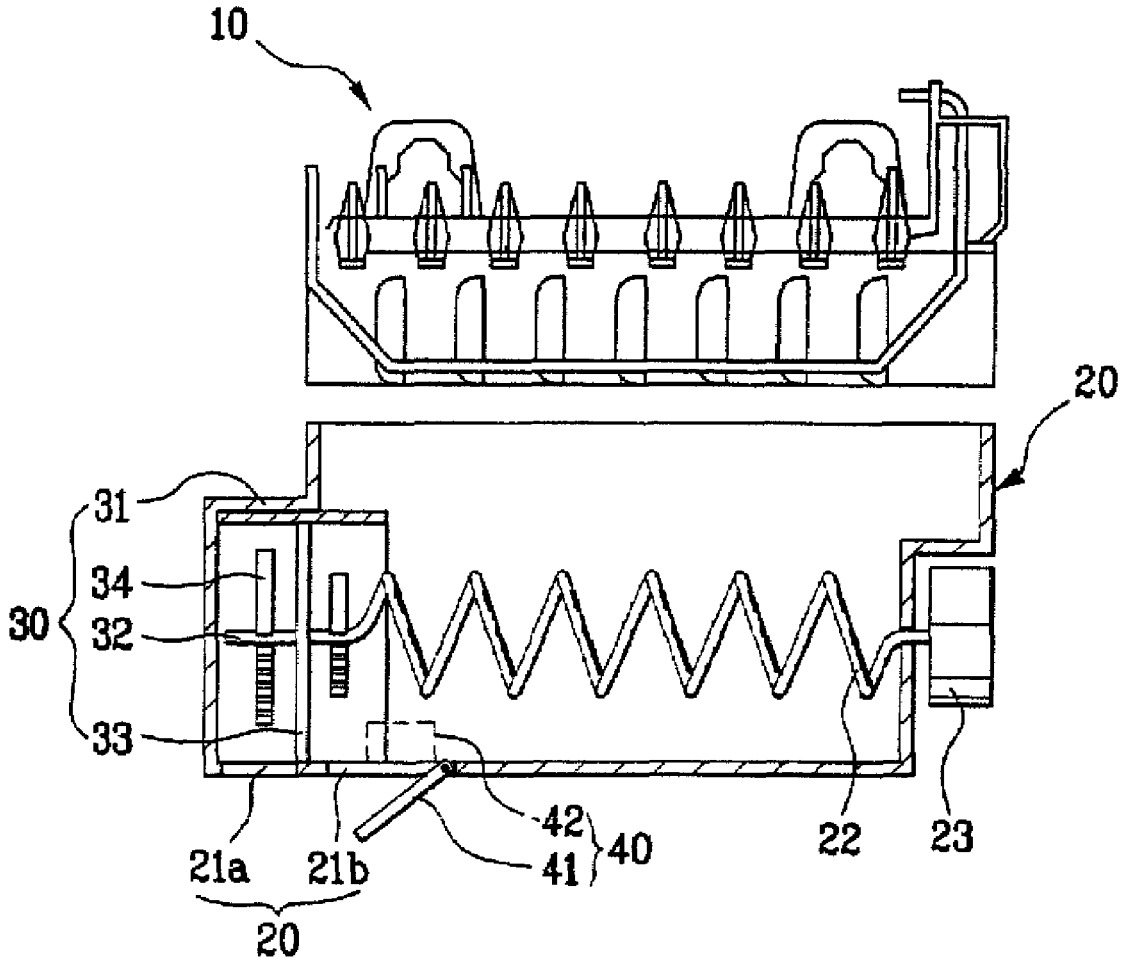
FIG. 3 illustrates a partial section of the ice maker and the ice container provided to the refrigerator in FIG. 1.
Figure 4:
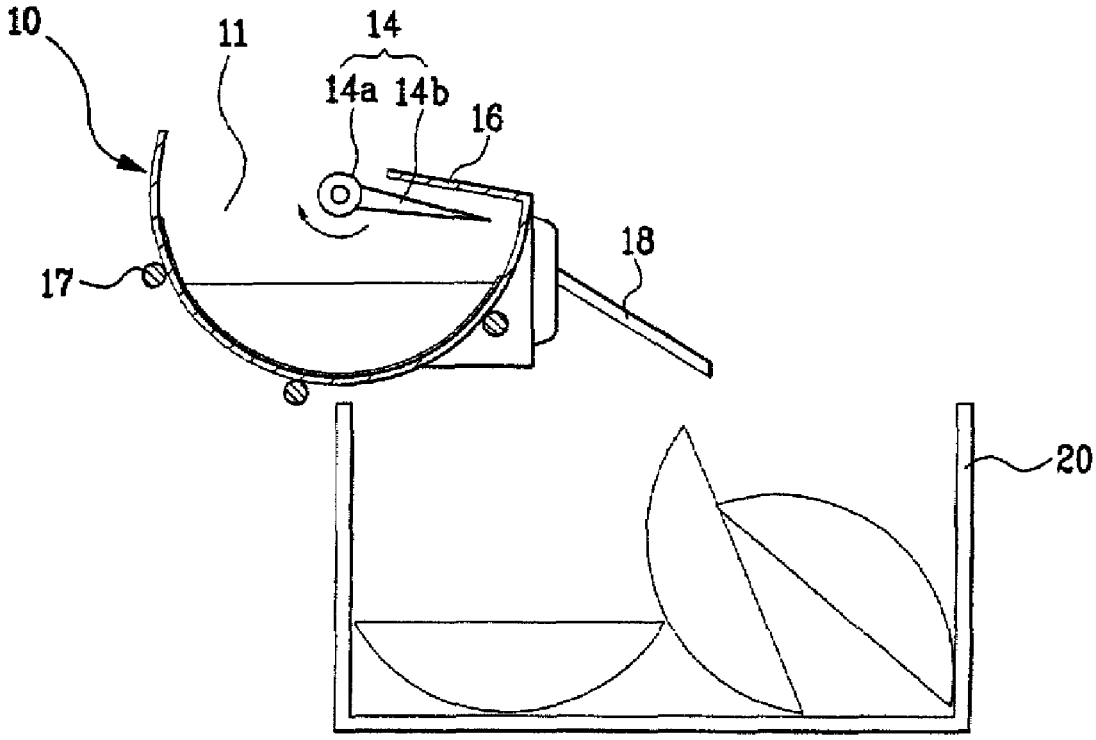
FIG. 4 illustrates a diagram showing an operation of the icemaker provided to a refrigerator in FIG. 1.

In the meantime, the refrigerator of the present invention is provided, not only with the water dispenser 3 for supplying cold water, but also an icemaker 10 for producing and supplying a plurality of ice pieces. The icemaker 10 will be described in more detail with reference to the attached drawings. For reference, FIG. 2 and FIG. 3 illustrate an icemaker and an ice container provided to the refrigerator in FIG. 1, and FIG. 4 illustrates a diagram showing operations of them.

The icemaker 10 and the ice container 20 are provided to the freezing chamber 2 under the refrigerating chamber 2.

Figure 2:
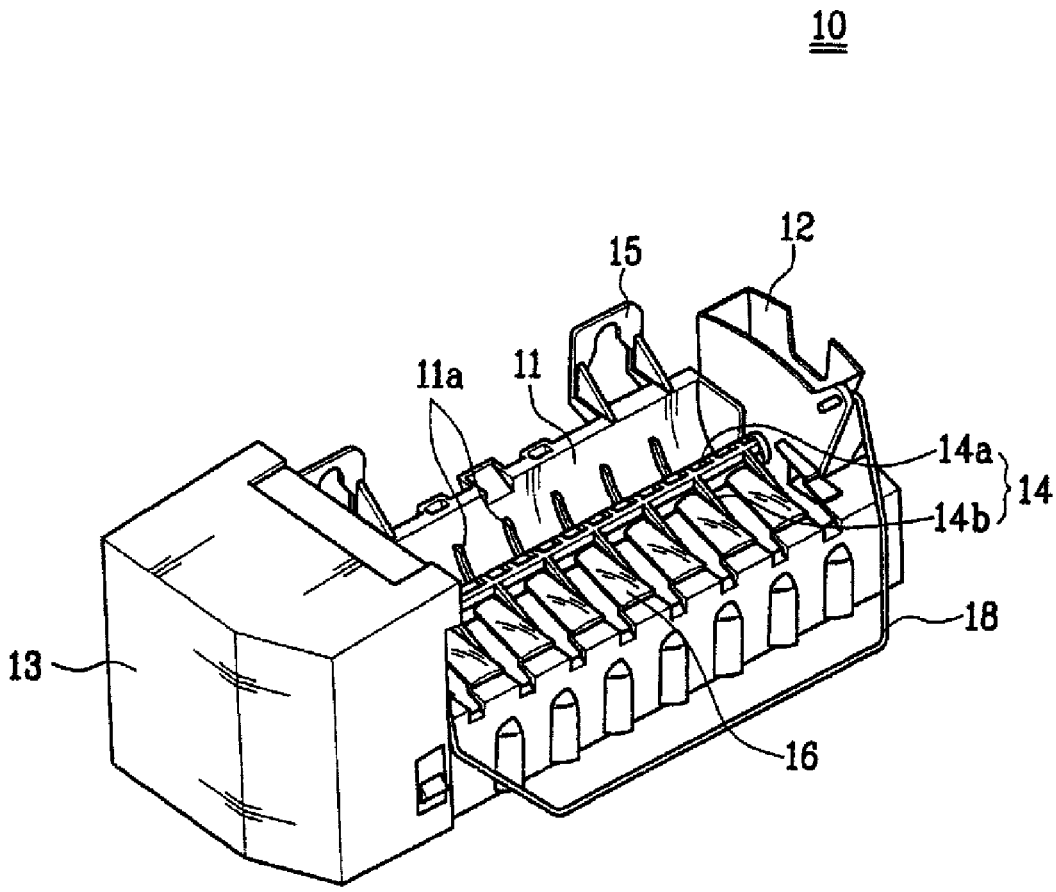
FIG. 2 illustrates a perspective view of an icemaker provided to the refrigerator in FIG. 1.

Referring to FIG. 2, the icemaker 10 includes an ice tray 11, a water supplying part 12, an ejector 14, and a motor 13. As shown in FIG. 2, the ice tray 11 has a semi-cylindrical form with an opened top, for storing water or ice therein. There are a plurality of ribs 11*a* on an inside surface to divide an inside space thereof into a plurality of spaces. As shown in FIG. 2, the ribs 11*a* are projected in a radial direction, and enable the ice tray 11 to produce a plurality of ice pieces.

As shown in FIG. 2, the water supplying part 12, provided to one side of the ice tray 11, supplies water to the ice tray 11. As shown in FIG. 2, there is a bracket 15 at a rear side of the ice tray 11, for fastening the icemaker 10 to the freezing chamber 2.

In the meantime, the ejector 14 includes a shaft 14*a*, and a plurality of pins 14*b*. As shown in FIG. 2, the shaft 14*a* is arranged to cross a center of an upper part of the ice tray 11 in a longitudinal direction. As shown in FIG. 2, the pins 14*b* are formed on an outside circumferential surface of the shaft 14*a* substantially perpendicular to the shaft 14*a*. It is preferable that the pins 14*b* are formed at regular intervals along a length direction of the shaft 14*a*, more preferably, one for each of the spaces in the ice tray 11 divided with the ribs 11*a*.

As shown in FIG. 2, the motor 13 is mounted on one point of an outside circumferential surface of the ice tray 11, and is connected to a shaft 14*a*. According to this, when the shaft 14*a* rotates by the motor 13, the pins 14*b* rotate together with the shaft 14*a*. Then, the pin 14*b* pushes the ice pieces in the ice tray 11 out to drop the ice pieces below the icemaker 10.

Referring to FIG. 3, there are a plurality of strips 16 in a front part of the ice tray 11, i.e., in an upper part of a side opposite to a side the brackets 15 are arranged. The strips 16 are extended from the upper part of the front side of the ice tray 11 to a part close to the shaft 14*a*, respectively. There is a gap between adjacent strips 16, through which the pins 14*b* pass when the shaft 14*a* rotates.

In the meantime, the ice pieces in the ice tray 11 are pushed by the pins 14*b*, separated from the ice tray 11, and drop on the strips 16 after the ice pieces are separated from the ice tray 11, fully. The ice pieces 16 dropped on the strips 16 are dropped below the icemaker 10, and stored in the ice container 20 under the icemaker 10. According to this, top surfaces of the strips 16 are required to guide the ice pieces separated from the ice tray 11, to drop below the icemaker 10, well. Therefore, as shown in FIGS. 2 and 4, in the present invention, it is preferable that the strips 16 are sloped such that parts near to the shaft 14*a* are higher than the front part of the ice tray 11.

A structure is also required for preventing the ice pieces separated from the ice tray 11 by the pins 14*b* from dropping to a rear side of the ice tray 11. For this, as shown in FIGS. 2 and 4, in the present invention, it is preferable that a rear side end of the ice tray 11 is higher than the shaft 14*a*, so that the ice pieces moved backward, and separated from the ice tray 11 by the ice tray 11 are guided to a front side of the ice tray 11, and drop on the strips 16, naturally.

In the meantime, referring to FIG. 4, there is a heater on an underside of the ice tray 11. The heater 17 heats a surface of the ice tray 11 for a short time period, and melts the ice pieces on a surface of the ice tray 11, slightly. According to this, the ice in the ice tray 11 can be separated easily when the shaft 14*a* and the pins 14*b* rotate.

Referring to FIGS. 2 and 4, the icemaker 10 is provided with a sensing arm for measuring an amount of ice in the ice container 20. The sensing arm, under the control of a controller (not shown), moves and measures the amount of ice in the ice container 20. For an example, the sensing arm 18 moves down at regular intervals, to move down much when the amount of the ice in the container 20 is small, and opposite to this, to move down little when the amount of the ice in the container 20 is much as the sensing arm 18 hits the ice earlier. According to this, the controller measures the amount of ice in the ice container 20 with reference to a move down depth of the sensing arm 18.

In the meantime, referring to FIGS. 3 and 4, the container 20 is arranged below the icemaker 10, and has an opened top for receiving, and storing the ice pieces from the icemaker 10. As shown in FIG. 3, the ice container 20 has a discharge opening 21 in one surface, for an example, in a bottom surface for discharging ice pieces downward.

In the meantime, the ice container 20 has a transfer device 22 for transferring the ice pieces in the ice container 20 to a side having the discharge opening 21 formed therein. As shown in FIG. 3, the transfer device 22 has a form of a thread, arranged across the ice container 20. The transfer device 22 is connected to a motor 23, and rotated, to transfer the ice pieces in the ice container 20 toward the discharge opening 21.

Referring to FIG. 3, inside of the ice container 20, there is a crusher 30 in a side part having the discharge opening 21 formed therein for crushing the ice transferred by the transfer device 22. The crusher 30 includes a housing 31, a shaft 32, a supporter 33, and blades 34.

The housing 31, over the discharge opening 21 in the ice container 20, has an opened side in a side facing the transfer device 22.

The shaft 32 is arranged in the housing 31 horizontally, and connected to, and rotate together with, the transfer device 22. The shaft 32 may be fabricated separate from the transfer device 22, and connected to the transfer device 22, or, as shown in FIG. 3, fabricated in a form extended from an end of the transfer device 22.

Referring to FIG. 3, the supporter 33 is provided to support the shaft 32 in the housing 31. That is, since the shaft 32 passes the supporter 33, the shaft 32 rotates in the housing 31 together with the transfer device 22.

The blades 34, fixed to the shaft, rotates together with the shaft 32, and crushes the ice pieces transferred by the transfer device 22. At least one blade 34 is provided, and, as shown in FIG. 3, when there are a plurality of blades 34, it is preferable that the blades 34 are arranged opposite to each other with respect to the supporter 33.

Once the icemaker 10 and the ice container 20 are provided to the freezing chamber 2, a plurality of ice pieces produced from the icemaker 10 is stored in the ice container 20. According to this, without requiring separation of the ice pieces from the ice tray, the user may open the door 2*a* on the freezing chamber 2, and take out the ice pieces from the ice container 20, which is convenient to the user. However, in this case, it is still not convenient, since opening of the door 2*a* is required, and frequent opening of the door 2*a* causes waste of energy, still.

Therefore, though not shown in FIG. 1, an ice dispenser may be provided to the door 2*a* on the freezing chamber 2 of the refrigerator of the present invention. In this instance, the ice dispenser, provided separate from the water dispenser 3, supplies the ice pieces produced in the icemaker 10 and stored in the ice container 20 to the user.

To do this, it is preferable that an ice discharging device 40 is provided to the ice container 20, for discharging an appropriate amount of ice, selectively. As shown in FIG. 3, the ice discharging device 40 includes an actuator 42, and a shutter 41.

The shutter 41, substantially in a plate form, provided to open/close the discharge opening 21. The shutter 41 is connected to the actuator 42, with, for an example, a lever (not shown). As the actuator, for an example, an actuator of a solenoid type may be used.

In the foregoing ice discharging device 40, the actuator 42 is operative in response to a control signal from the controller, and the shutter 41 regulates an amount of opening of the discharging device 21 according to operation of the actuator 42.

In the meantime, in the present invention, it is preferable that the ice discharging device 40 provided thus can discharge the ice crushed at the crusher 30, or the ice stored in the ice container 20, selectively.

To do this, as shown in FIG. 3, the discharge opening 21 may include a first discharge opening 21*a* and a second discharge opening 21*b*, and the shutter 41 is arranged to open the second discharge opening 21*b* selectively. As shown in FIG. 3, the first discharge opening 21*a* is formed under the crusher 30, and the second discharge opening 21*b* is formed under an end part of the transfer device 22 on a side of the crusher 30.

Once the discharge opening 21 and the ice discharging device 40 have the forgoing structures, the ice discharging device 40 can discharge crushed, or uncrushed ice selectively, which will be described in more detail.

If the user desired to have crushed ice supplied thereto, the second discharge opening 21*b* is closed with the shutter 41. Then, the ice pieces in the ice container 20 is transferred to the crusher 30 by the transfer device 22, and the ice crushed at the crusher 30 is discharged through the opened first discharge opening 21*a*.

On the other hand, if the user desires the uncrushed ice, the shutter 41 opens the second discharge opening 21*b*. Then, the ice stored in the ice container is discharged through the second discharge opening 21*b* before the ice is transferred to the crusher 30. According to this, the user can have the uncrushed ice supplied thereto.

In the meantime, the structure in which the crushed or uncrushed ice can be supplied selectively is not limited to above structure. For an example, one discharge opening may be provided, and one shutter regulates an amount of opening of the discharge opening. That is, when the shutter opens the discharge opening slightly, the ice is discharged after being crushed at the crusher 30, and when the shutter opens the discharge opening fully, the ice is discharged as it is without being crushed.

The operation of the refrigerator of the present invention will be described.

If the controller (not shown) determines that there is shortage of ice in the ice container 20 by the operation of the sensing arm 18, water is supplied to the water supplying part 12 in the ice container 10. The water supplied to the water supplying part 12 in turn fills the spaces between the ribs 11*a* of the ice tray 11, are frozen by the cold air in the freezing chamber 2. Accordingly, the ice tray 11 can produce the ice pieces of fixed sizes by the ribs 11*a*.

When the ice is formed as a preset time is passed, the heater 17 heats the ice tray 11 for a short while. According to this, the ice on the surface of the ice tray 11 melts slightly, and separated from the ice tray 11. Then, as the motor 13 is put into operation, the shaft 14*a* and the pins 14*b* rotate. Then, the pin 14*b* pushes out the ice between adjacent ribs 11*a* in a circumferential direction of the ice tray 11 until the ice, separated from the ice tray 11 fully by the pin 14*b*, drops onto the strip 16, therefrom, below the icemaker 10, and received at the ice container 20.

When a preset amount of ice is stuffed in the ice container 20 by repeating above process, the controller stops production of the ice as the sensing arm senses the amount of the ice. Of course, if the sensing arm 18 senses that there is shortage of the ice still, the foregoing process is repeated to produce ice continuously, which is stored in the ice container 20.

In the meantime, when the user operates a control panel on an outside surface of the door 2*a*, in a state the ice is stuffed in the ice container 20, the user can have the crushed, or uncrushed ice supplied thereto through the ice dispenser, which process will be described, hereafter.

When the user operates the control panel, to select a function for having the crushed ice supplied thereto, as described before, the shutter 41 closes the second discharge opening 21*b* a little, or opens the discharge opening 21, a little. Under this state, the motor 23 is rotated, to transfer large sized ice from the ice container 20 to the crusher 30. Then, the ice in the ice container 20 is transferred to the crusher 30, entirely. According to this, the ice crushed in the crusher 30 is discharged through the first discharge opening 21*a*. Thereafter, the discharged ice is supplied to the user through the ice dispenser.

On the other hand, if the user selects a function for having large sized uncrushed ice supplied thereto by operating the control panel, the shutter 41 opens the second discharge opening 21*b*, or the discharge opening 21, almost fully. Then, the ice transferred to the crusher 30 by the transfer device 22 is discharged through the discharge opening 21 before the ice reaches to the crusher 30, and supplied to the user through the ice dispenser.

Thus, the refrigerator of the present invention can dispense crushed, or uncrushed ice selectively. However, the refrigerator of the present invention described with reference to FIGS. 1~4 has the following disadvantages.

First, in the case of the refrigerator having no ice dispenser provided to the door on the freezing chamber, the opening of door for taking out the ice not only is inconvenient, but also wastes energy.

Second, in the case of the refrigerator having an ice dispenser provided to the door on the freezing chamber, since the freezing chamber and the ice dispenser are provided to the lower part of the refrigerating chamber 1, the user has inconvenience of taking the ice with bending oneself forward.

Third, when the water dispenser, and the ice dispenser are provided, a structure of the refrigerator becomes complicate to cause difficulty in fabrication and to cost high. Moreover, the requirement for distinguishing between the water dispenser and the ice dispenser is not convenient for the user.

Accordingly, the present invention provides a refrigerator of improved structure in which the problems of the foregoing embodiments are modified. In the refrigerator of improved structure of the present invention, a dispenser is provided to a door on the refrigerating chamber over the freezing chamber. According to this, the user can use the dispenser very easily, and conveniently. Moreover, the structure enables the user to take water from a water tank in the refrigerating chamber through the dispenser. Thus, the user can take ice or water from a dispenser provided at a height convenient to use, i.e., a height of waist or breast of the user.

Figure 5:
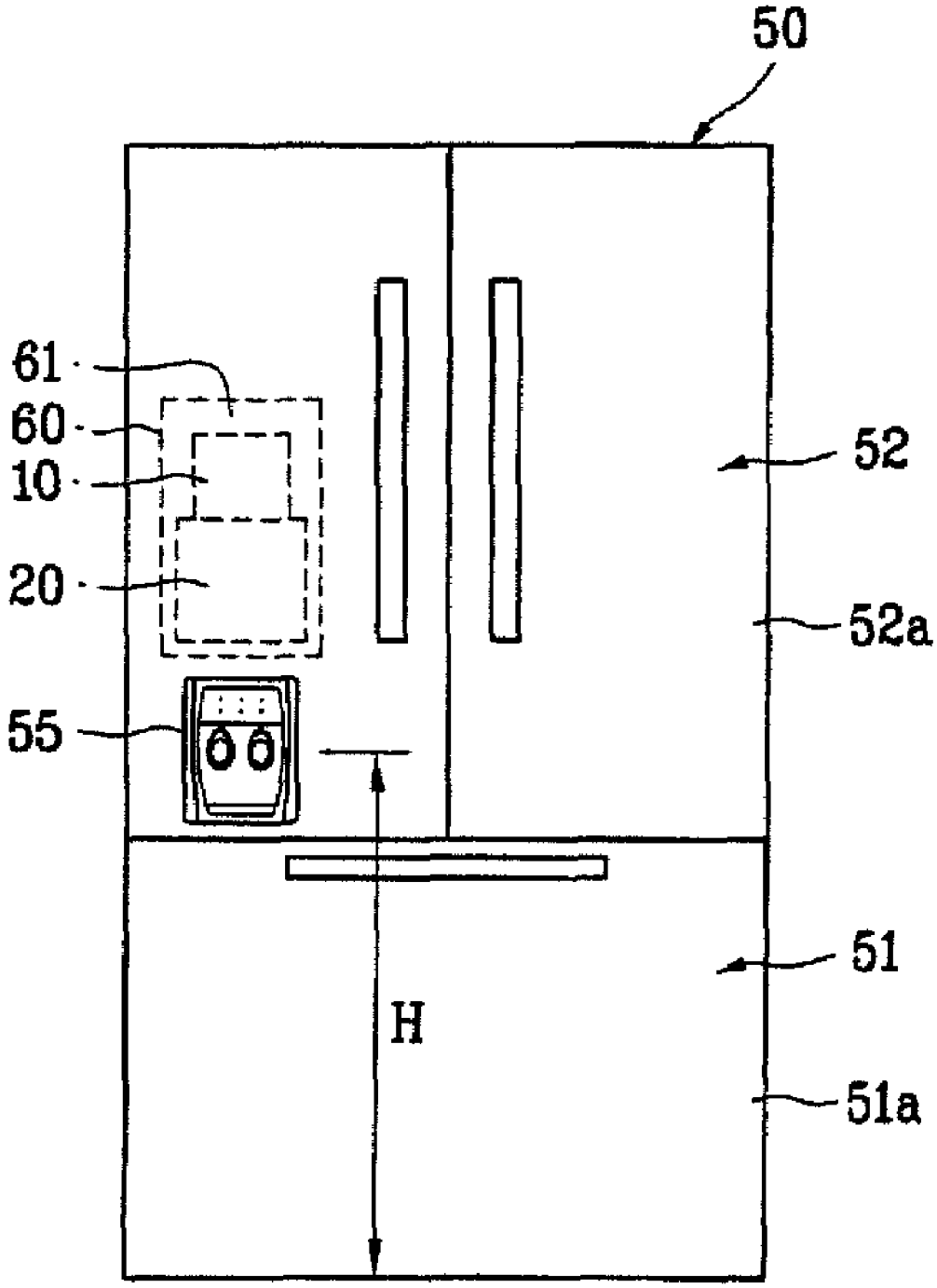
FIG. 5 illustrates a diagram of an improved refrigerator in accordance with a preferred embodiment of the present invention.
Figure 8:
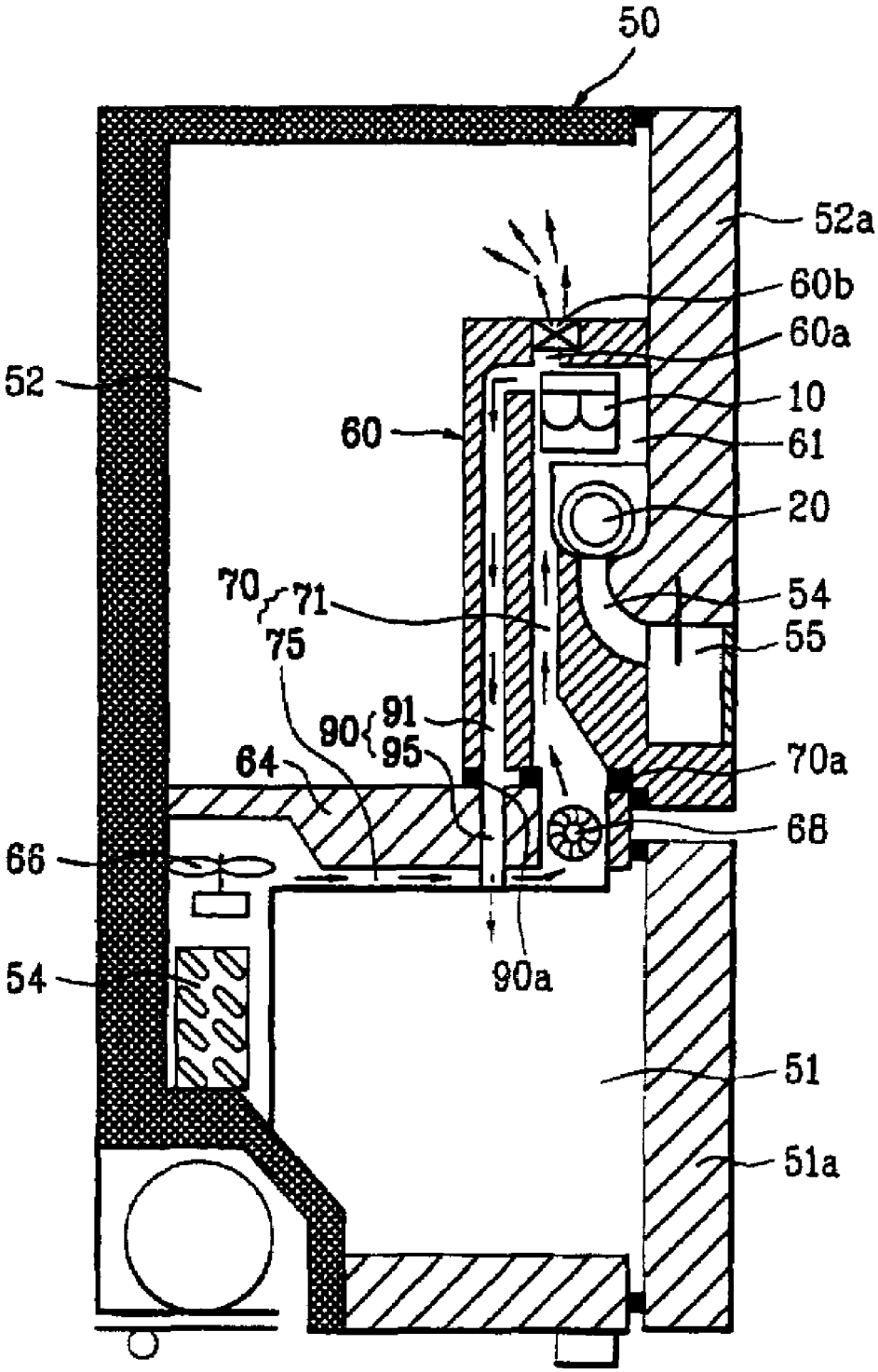
FIG. 8 illustrates a side section showing a third embodiment of the refrigerator in FIG. 5.
Figure 9:
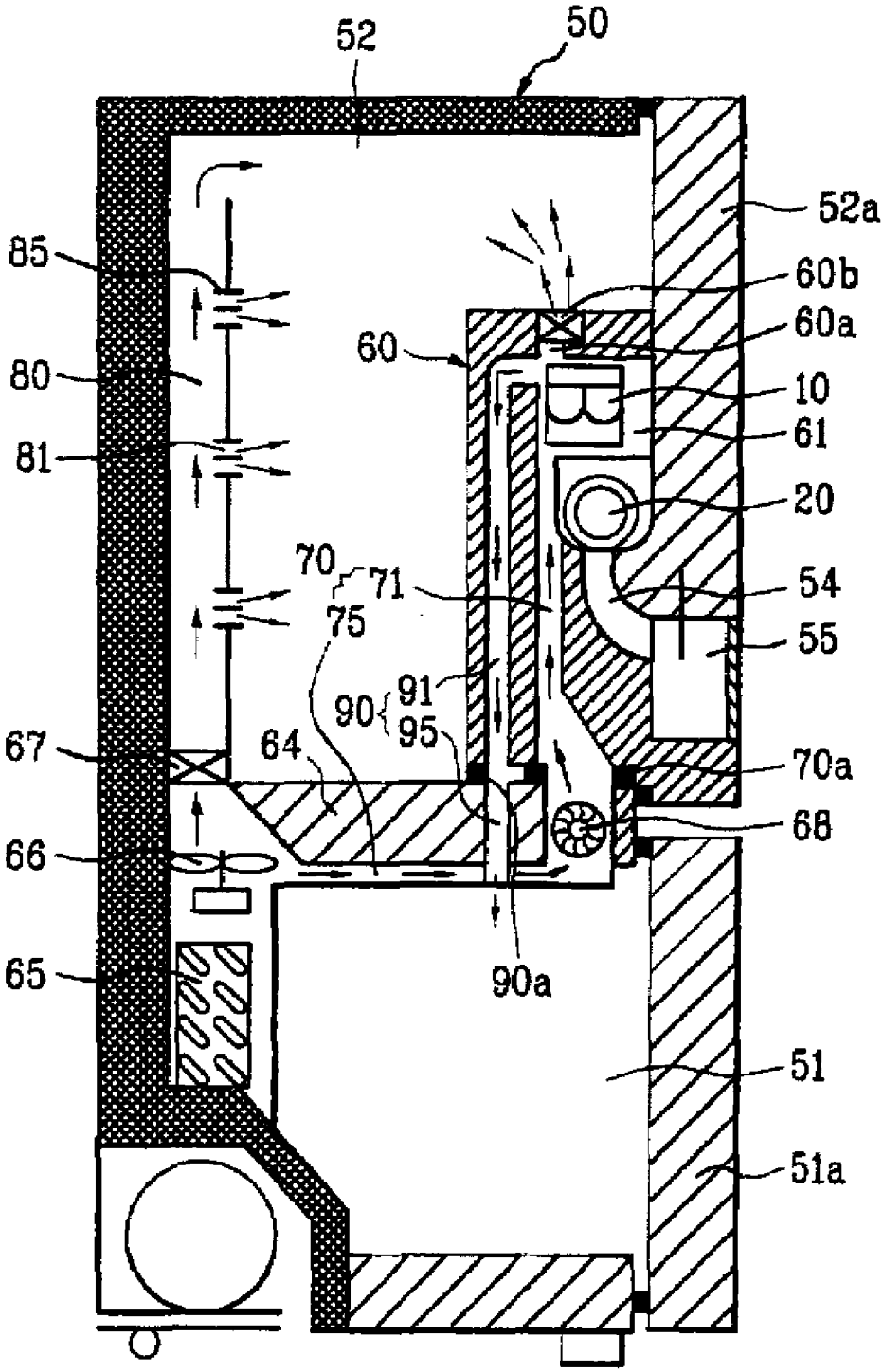
FIG. 9 illustrates a side section showing a fourth embodiment of the refrigerator in FIG. 5.
Figure 10:
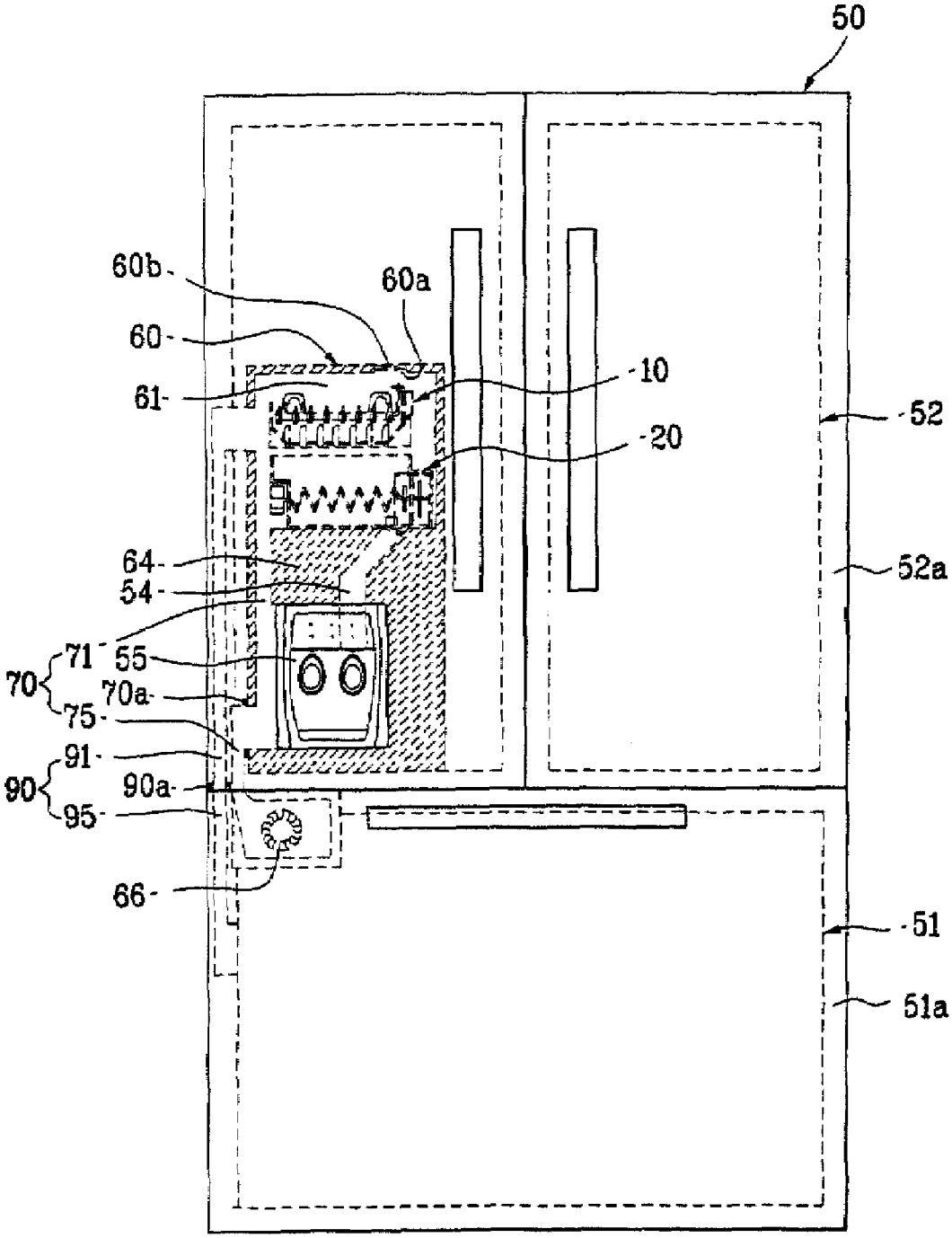
FIG. 10 illustrates a front view of a fifth embodiment of the refrigerator in FIG. 5, showing a first and a third ducts.

FIGS. 5 to 10 illustrate the refrigerators of improved structures of the present invention, referring to which the refrigerator of improved structure of the present invention will be described. For reference, FIG. 5 illustrates a diagram of an improved refrigerator in accordance with a preferred embodiment of the present invention, FIGS. 6 to 9 illustrate side sections each showing first to fourth preferred embodiment refrigerator of the refrigerator in FIG. 5 in succession, and FIG. 10 illustrates a front view of a fifth embodiment of the refrigerator in FIG. 5, showing a first and a third ducts.

A common structure for the first to fourth embodiment refrigerators of the present invention will be described, with reference to FIGS. 5~9.

Referring to FIGS. 5~9, there are a freezing chamber 52 in an upper part of the cabinet 50, and a refrigerating chamber 51 in a lower part of the cabinet 50. As shown in FIGS. 6~9, the refrigerating chamber 52 and the freezing chamber 51 are compartmentalized into independent spaces with a mullion wall 64.

Referring to FIGS. 6~9, the freezing chamber 51 is provided with an evaporator 65. There is a fan adjacent to the evaporator 65. According to this, the cold air formed in the vicinity of the evaporator 65 is supplied to the freezing chamber 51 or the refrigerating chamber 52 by the fan 66.

In the meantime, the evaporator 65 is provided, not only in the freezing chamber 51. That is, though not shown, the evaporator 65 can also be provided to the refrigerating chamber 52. Moreover, a plurality of the evaporators 65 may be provided to the refrigerating chamber 52 and the freezing chamber 51, respectively. However, as shown in FIGS. 6~9, the embodiments will be described, taking a case the evaporator 65 is provided to the freezing chamber 51, as an example.

The refrigerating chamber 52 and the freezing chamber 51 are provided with doors 52*a* and 51*a*, respectively. The door 52*a* on the refrigerating chamber 52 is provided with a case 61 and a dispenser 55, and the case 61 has an icemaker 10 and an ice container 20 provided therein. Of course, the ice container 20 may have the transfer device and the crusher described with reference to FIG. 3.

Referring to FIGS. 6~9, the case 61 is provided with a door 52*a*. The case 61 is formed of a thermal insulating material, for preventing heat exchange between the refrigerating chamber 52 and the cavity 61.

The case 61 is provided, for an example, in an upper part of the door 52*a*, for arranging the dispenser 55 at a height convenient to use, i.e., at a height of waist or breast of an average people using the refrigerator. That is, this is because, if the case 61 is arranged at a high position, an appropriate height 'H' for arranging the dispenser 55 which is required to be arranged at a position lower than the case 61 can be secured. Meanwhile, the appropriate height 'H' may be set, not with reference to the height of waist or breast of the user, but with reference to other criteria.

There is a cavity 61 in the case 61, and the icemaker 10 and the ice container 20 are in the cavity 61. Since structures of the icemaker 10 and the ice container 2 are similar to the structures described with reference to FIGS. 2 and 4, description of which will be omitted. However, as shown in FIGS. 6~9, the icemaker 10 is arranged in an upper part of the cavity 61, and the ice container 20 is arranged in a lower part of the cavity 61. The ice produced at the icemaker 10 may be dropped down, and stored in the ice container 20.

Referring to FIGS. 6~9, the dispenser 55 is provided to a door 52*a* on the refrigerating chamber 52. There is an ice chute 54 in the door 52*a* making the cavity 61 and the dispenser 55 in communication. According to this, the ice can be supplied from the ice container 20 to the user at the dispenser 55 via the ice chute 54.

In the meantime, the refrigerator 52 may be provided with a water tank (not shown) for cooling water with the cold air in the refrigerating chamber 52. Since the water tank is in communication with the dispenser 55, the user may have the water, or the ice supplied thereto, selectively.

Structural characteristics of the embodiments will be described for each of the embodiments.

Figure 6:
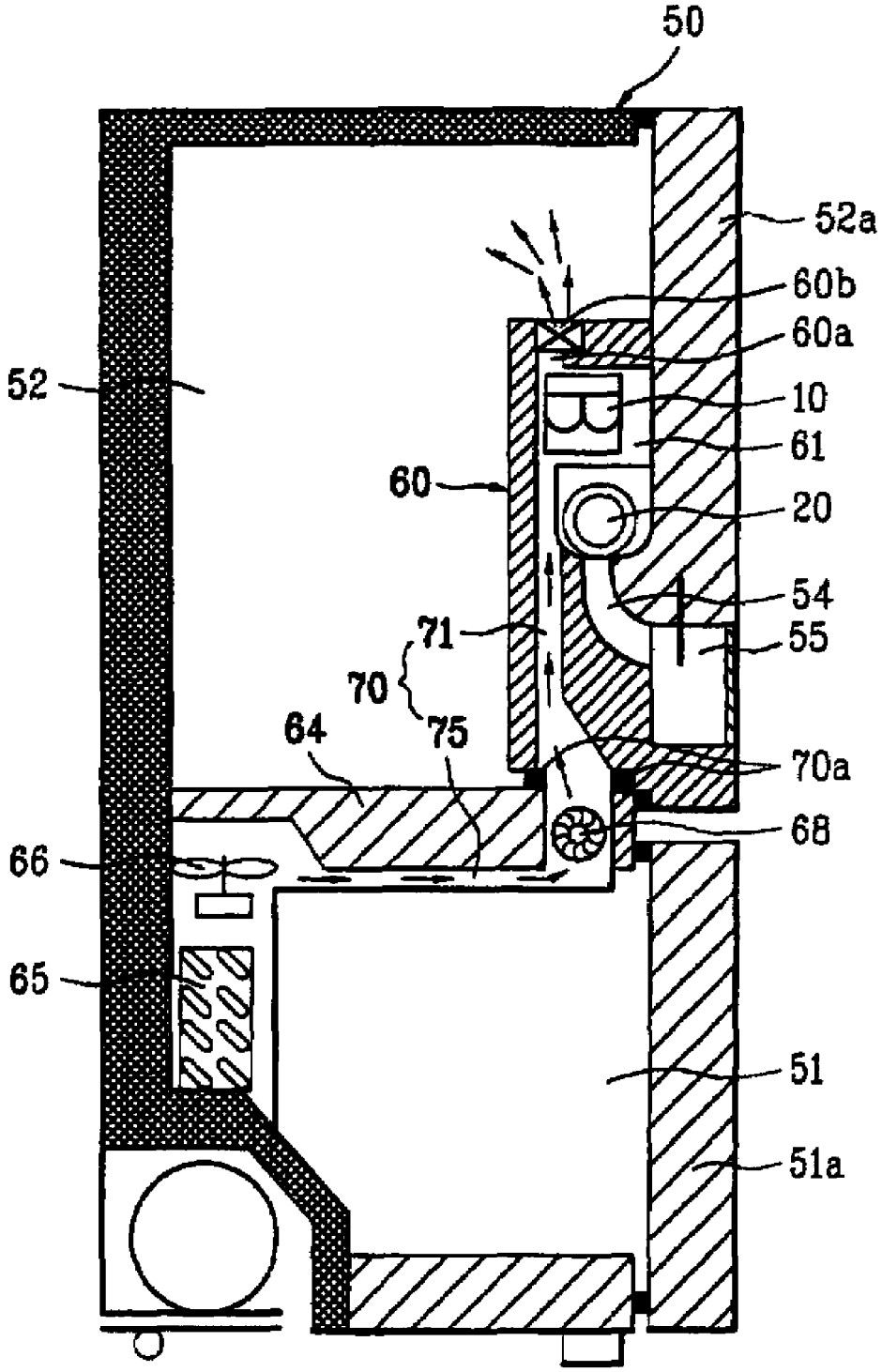
FIG. 6 illustrates a side section showing a first embodiment of the refrigerator in FIG. 5.

Referring to FIG. 6, the refrigerator in accordance with a first preferred embodiment of the present invention is provided with a first duct 70 for supplying the cold air formed around the evaporator 65 in the freezing chamber 51 to the cavity 61. The first duct 70 passes the mullion wall 64, and has one end adjacent to the evaporator 65 in the freezing chamber 51, and the other end in communication with the cavity 61.

Referring to FIG. 6, the first duct 70 includes a first part 71 and a second part 75. As shown in FIG. 6, the first part is provided to the door 52*a*, and has one end arranged at a lower end of the door 52*a*, and the other end in communication with the cavity 61.

The second part 75 is provided to the freezing chamber 51 passed through the mullion wall 64, and has one end arranged adjacent to the evaporator 65, and the other end arrange at an upper part of the mullion wall 64. As shown in FIG. 6, the second part 75 is provided to a bottom surface of the mullion wall 64 or a sidewall surface of the freezing chamber 51.

If the first duct 70 is provided thus, the evaporator 65 can supply cold air from a neighborhood of the evaporator 65 to the cavity 61. For effective supply of the cold air from the neighborhood of the evaporator 65 to the cavity 61, it is preferable that a first fan 66 is provided as shown in FIG. 6. The first fan 66, arranged between the evaporator 65 and the first duct 70, supplies the cold air from the neighborhood of the evaporator 65 to the first duct 70.

In the meantime, as shown in FIG. 6, the duct 70 has a bent part. Therefore, the cold air from the first fan 66 forms turbulence at the bent part, and fails fast supply to the cavity 61. Therefore, as shown in FIG. 6, the refrigerator of the present invention is further provided with a second fan 68. The second fan 68 inside of the bent part of the first duct 70, turns a direction of the cold air flowing in the first duct 70, and supplies to the cavity 61, quickly.

The second fan 68 can be, for an example, a cross flow fan that can change an air flow direction substantially perpendicular to a rotation shaft of the fan. For easy mounting and rigid support of the second fan 68, the second fan 68 may be provided to a part having the first duct 70 passed through the mullion wall 64.

In the meantime, in the foregoing first duct 70, the first part 71 is separated from the second part 75 when the door 52*a* is opened, and vice versa. Therefore, for preventing the cold air in the first duct 70 from leaking to an outside of the refrigerator when the door 52*a* is closed, there is a gasket 70*a* provided to a connection part of the first part 71 and the second part 75.

In the meantime, referring to FIG. 6, the case 60 has a hole 60*a* for making the refrigerating chamber 52 and the cavity 61 in communication. The hole 60*a* enables supply of the cold air supplied to the cavity 61 through the first duct 70 to the refrigerating chamber 52. Then, production of the ice as well as cooling of the refrigerating chamber 52 are made possible by using the cold air in the neighborhood of the evaporator 65.

It is preferable that the hole 60*a* is provided to a top of the case 60, because the cold air discharged into the refrigerating chamber 52 through the hole 60*a* has a temperature lower than the refrigerating chamber 52, and tends to go down. Therefore, if the hole 60*a* is formed in the top of the case 60, the cold air can be supplied to every part of the refrigerating chamber 52.

As shown in FIG. 6, in the case the hole 60*a* is formed to the case 60 thus, it is preferable that the hole 60*a* is provided with a damper 60*b*. The damper 60*b* closes/opens, or regulates opening of the hole 60*a*. Once the damper 60*b* is provided to the hole 60*a*, the cold air supplied to the cavity 61 can be supplied to the refrigerating chamber 52 only when a temperature of the refrigerating chamber 52 is outside of a preset temperature range.

The operation of the refrigerator in accordance with the first preferred embodiment of the present invention will be described.

The cold air is blown from the neighborhood of the evaporator 65 to the first duct 70 by the first fan 66. The cold air introduced into the first duct 70 is involved in a flow direction change by the second fan 68, and supplied to the cavity 61.

The icemaker 10 produces ice by using the cold air supplied to the cavity 61, and the produced ice is stored in the ice container 20. Since the cold air is supplied to the cavity 61 continuously, the ice stored in the ice container 20 does not melt.

The ice stored in the ice container 20 is supplied to the user through the dispenser 55 in an outside surface of the door 52*a*. Since the dispenser 55 is at the waist or breast height of the user, the user can have the ice supplied thereto without bending oneself forward.

In the meantime, if the temperature of the refrigerating chamber 52 is outside of the preset temperature range, the damper 60*b* on the hole 60*a* of the case 60 is opened. Therefore, the cold air is supplied from the cavity 61 to the refrigerating chamber 52, to cool down the refrigerating chamber 52 again, to maintain the preset temperature range.

In the meantime, when the door 52*a* is opened thus, the first part 71 of the first duct 70 is separated from the second part 75. Therefore, for preventing the cold air from leaking to the outside of the refrigerator, the first fan 66 and the second fan 68 stop when the door 52*a* is opened.

Figure 7:
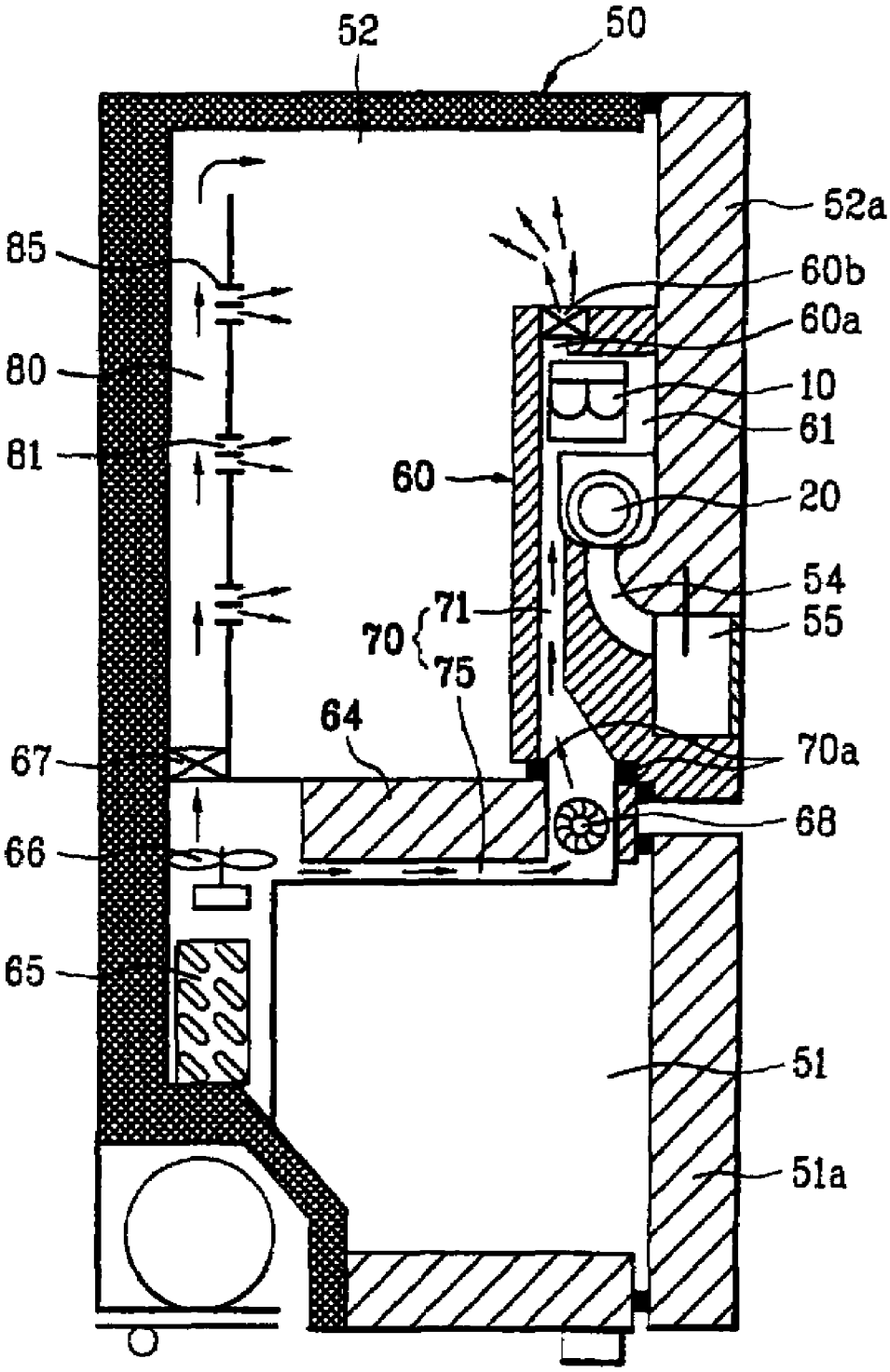
FIG. 7 illustrates a side section showing a second embodiment of the refrigerator in FIG. 5.

Next, referring to FIG. 7, the refrigerator in accordance with a second preferred embodiment of the present invention includes a cabinet 50, a case 60, a first duct 70, a second duct 80, the icemaker 10, the ice container 20, and the dispenser 55. Parts other than the second duct 80 are identical to the first embodiment.

For an example, the refrigerator in accordance with a second preferred embodiment of the present invention includes all other parts described in the first embodiment, such as the first and second fans 66, and 68, and the damper 60*b*, and the like. As the refrigerator in accordance with a first preferred embodiment of the present invention is described with reference to FIG. 6, the characteristics of the second embodiment distinctive from the first embodiment, i.e., only the second duct 80 will be described.

Referring to FIG. 7, the second duct 80 has one end arranged adjacent to the evaporator 65, and the other end arranged in the refrigerating chamber 52. For this, the second duct 80 passes the mullion wall 64, or, as shown in FIG. 7, an opening is provided to the mullion wall 64, and the second duct 80 is made to be in communication with the opening. The second duct 80 supplies the cold air from a neighborhood of the evaporator 65 to the refrigerating chamber 52, directly.

In the meantime, as shown in FIG. 7, it is preferable that the second duct 80 has the other end arranged in an upper part of the refrigerating chamber 52, for moving down the cold air discharged through the other end of the second duct 80 to a lower part of the refrigerating chamber 52, and cooling down every part of the refrigerating chamber 52.

In addition to this, for more effective supply of the cold air to every part of the refrigerating chamber 52, there are a plurality of holes 81 in an outside circumferential surface of the second duct 80. As shown in FIG. 7, the plurality of holes 81 are provided at substantially regular intervals along a length direction of the second duct 80. Therefore, the cold air in the second duct 80 can be supplied to every parts of the refrigerating chamber 52 through the holes 81.

Referring to FIG. 7, in the second embodiment, the hole 81 has louvers 85, additionally. The louver 85 controls a discharge direction of the cold air supplied to the refrigerating chamber 52 through the holes 81. Therefore, once the louver 85 is provided, the cold air can be supplied to every part of the refrigerating chamber 52, more effectively.

In the meantime, in the second embodiment refrigerator, there may be a damper 67 provided thereto for controlling an amount of cold air supplied to the second duct 90. As shown in FIG. 7, the damper 67, provided to an end of the second duct 80, for opening/closing or controlling opening of the one end of the second duct 80. Once the damper 67 is provided thus, the cold air supply to the refrigerating chamber 52 can be stopped when the temperature of the refrigerating chamber 52 is low.

A process for supplying cold air in the refrigerator in accordance with the second preferred embodiment of the present invention having the second duct 80 and the first duct 70 provided thereto will be described.

When the temperature of the refrigerating chamber 52 reaches to a present temperature range, both of the dampers 60*b* and 67 are closed. Then, the cold air is supplied from the neighborhood of the evaporator 65 only to the cavity 61. The cold air supplied to the cavity 61 maintains the cavity 61 to be at a subzero temperature, such that, not only the icemaker 10 can produce ice, but also the ice stored in the ice container 20 can be conserved for a long time period.

Next, if the temperature of the refrigerating chamber 52 rises to a temperature outside of the preset temperature range, at least one of the dampers 60*b* and 67 are opened. If both of the dampers 60*b* and 67 are opened, enabling much of the cold air to flow in the front part and the rear part of the refrigerating chamber 52 uniformly, every part of the refrigerating chamber 52 can be cooled down within a short time period, uniformly.

Referring to FIG. 8, the refrigerator in accordance with a third preferred embodiment of the present invention includes the cabinet 50, the case 60, the first duct 70, a third duct 90, the icemaker 10, the ice container 20, and the dispenser 55. Parts except the third duct 90 are identical to the parts described in the first embodiment.

In the meantime, the refrigerator in accordance with the third preferred embodiment of the present invention may include all other parts described in the first preferred embodiment, such as the first and second fans 66 and 68, and the damper 60*b*. As the refrigerator in accordance with a first preferred embodiment of the present invention has been described with reference to FIG. 6, characteristics of the third preferred embodiment of the present invention, distinctive from the first embodiment, i.e., the third duct 90 will only be described.

Referring to FIG. 8, the third duct 90 has one end in communication with the freezing chamber 51, and the other end in communication with the cavity 61. The third duct 90 is provided to the case 60, or the door 52*a*, and passes through the mullion wall 64. The third duct 90 provided thus supplies the cold air from the cavity 61 to the freezing chamber 51. Therefore, since the cold air formed in the neighborhood of the evaporator 65 cools down the freezing chamber 51 again, after cooling down the cavity 61, an energy efficiency can be enhanced.

In the meantime, referring to FIG. 8, the third duct 90 includes a third part 91 and a fourth part 95. The third part 91 has one end provided at a lower end of the door 52*a*, and the other end in communication with the cavity 61. The fourth part 95 passes through the mullion wall 64, and has one end provided on an upper surface of the mullion wall 64, and the other end in communication with the freezing chamber 51.

In the third duct 90, the third part 91 is separated from the fourth part 95 when the door 52*a* is opened, vice versa. Therefore, as shown in FIG. 8, for preventing the cold air from leaking to an outside of the refrigerator when the door 52*a* is closed, a gasket 90*a* is provided to a connection part of the third part 91 and the fourth part 75.

Since the refrigerator in accordance with a third preferred embodiment of the present invention supplies the cold air to the cavity 61 through the first duct 70, the icemaker 10 can produce the ice by using the cold air supplied to the cavity 61, and the ice container 20 can store the ice. Since the cold air, supplied to the cavity 61, is supplied to the refrigerating chamber 51 through the third duct 90, an energy efficiency can be enhanced. In the meantime, if the refrigerating chamber 52 temperature rises to a temperature outside of the present temperature range, the damper 60*b* is opened. Therefore, the cold air supplied to the cavity 61 is supplied to the refrigerating chamber 52.

In the meantime, referring to FIG. 9, the refrigerator in accordance with a fourth preferred embodiment of the present invention includes the cabinet 50, the case 60, the first duct 70, the second duct 80, the third duct 90, the icemaker 10, the ice container 20, and the dispenser 55. The fourth embodiment refrigerator includes all parts of the first to third embodiment refrigerator, and has all advantages thereof. Since the parts have been described with reference to FIGS. 6~8, repetitive description of which will be omitted.

In the meantime, referring to FIG. 10, the refrigerator in accordance with a fifth preferred embodiment of the present invention has a structure similar to the first to fourth refrigerators respectively, except that parts of the first duct 70 and the third duct 90 are provided to a sidewall of the cabinet 50 respectively, which will be described.

The third duct 70 includes a first part 71 provided to the door 52*a*, and a second part 75 provided to the sidewall of the cabinet 50. The first part 71 is in communication with the cavity 61, and the second part 75 makes the freezing chamber 51 and the first part 71 in communication. The first part 71 and the second part 75 are connected to each other when the door 52*a* is closed, and there is a gasket 70*a* at a connection part of the first part 71 and the second part 75 for prevention of the cold air from leaking.

The third duct 90 includes a third part 91 provided to the door 52*a* and a fourth part 95 provided to the sidewall of the cabinet 50. The third part 91 is in communication with the cavity 61, and the fourth part 95 makes the freezing chamber 51 and the third part 91 in communication. The third part 91 and the fourth part 95 are connected to each other when the door 52*a* is closed, and there is a gasket 90*a* at a connection part of the third part 91 and the fourth part 95.

In the meantime, referring to FIG. 10, the first duct 70 may be applied to the refrigerators in accordance with first to fourth preferred embodiments of the present invention described with reference to FIGS. 6 and 9, respectively. Moreover, the third duct 90 described with reference to FIG. 10 can be applied to the refrigerators in accordance with third and fourth preferred embodiments of the present invention described with reference to FIGS. 8 and 9 respectively. Thus, the refrigerator of the present invention can be embodied in a variety of embodiments.

As has been described, the refrigerator of the present invention has the following advantages.

First, the dispenser at a height of user's waist or breast provides convenience of use.

Second, it is convenient as ice or water is available without opening a door.

Third, both an icemaker and an ice container are provided to a door. Therefore, spaces of the freezing chamber and the refrigerating chamber can be used, effectively.

Fourth, the cold air formed in the freezing chamber is introduced into the refrigerating chamber through the icemaker. Therefore, direct introduction of the cold air into the refrigerating chamber, and consequential local overcooling of the refrigerating chamber can be prevented.

Fifth, since the cold air supplied to the icemaker is supplied to the refrigerating chamber and the freezing chamber, the refrigerator has a high energy efficiency.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A refrigerator comprising:

a cabinet including one or more walls defining at least one chamber;

an evaporator positioned in the cabinet;

a door including one or more walls defining a cavity;

an interface on the door corresponding to the cavity and configured to receive air;

a first duct configured to guide air that has been cooled by the evaporator from the evaporator to an interface of the cabinet that corresponds to the interface on the door through which the cooled evaporator air is passed to enable regulation of a temperature associated with the cavity; and a supplemental duct configured to guide the cooled evaporator air to the freezing chamber, wherein the one or more walls defining at least one chamber include one or more walls defining a freezing chamber and a refrigerating chamber, at least one of the one or more walls separating the freezing chamber from the refrigerating chamber, wherein the supplemental duct includes:

a first part included on the door; and a second part that passes the at least one wall separating the freezing chamber from the refrigerating chamber, the second part being configured to interface with the freezing chamber and interface with the first part when the door is in a closed position.

2. The refrigerator as claimed in claim 1, further comprising an icemaker positioned in the cavity, wherein the first duct is configured to guide air cooled by the evaporator along a portion of a path toward the icemaker to enable regulation of a temperature associated with the icemaker.

3. The refrigerator as claimed in claim 1, further comprising an ice storage bin positioned in the cavity, wherein the first duct is configured to guide air cooled by the evaporator along a portion of a path toward the icemaker to enable regulation of a temperature associated with the ice storage bin.

4. The refrigerator as claimed in claim 1, wherein the at least one chamber is a freezing chamber and the evaporator is positioned in the freezing chamber.

5. The refrigerator as claimed in claim 1, wherein the at least one chamber is a refrigerating chamber and the evaporator is positioned in the refrigerating chamber.

6. The refrigerator as claimed in claim 1, further comprising a dispenser positioned in the door, the dispenser being configured to communicate with the cavity.

7. The refrigerator as claimed in claim 1, further comprising a second duct included on the door extending from the interface on the door and in communication with the air in the cavity.

8. The refrigerator as claimed in claim 7, wherein the second duct is in thermal communication with the air in the cavity.

9. The refrigerator as claimed in claim 7, wherein the second duct is configured to guide air to the cavity.

10. The refrigerator as claimed in claim 1, wherein the one or more walls defining the cavity comprise a thermal insulating material and surround the cavity.

11. The refrigerator as claimed in claim 1, wherein the interface of the cabinet is configured to communicate with the interface on the door when the door is in a closed position.

12. The refrigerator as claimed in claim 11, further comprising a gasket provided at a point of connection between the interface of the cabinet and the interface on the door.

13. The refrigerator as claimed in claim 1, further comprising a fan adjacent to the evaporator configured to guide air to the first duct.

14. The refrigerator as claimed in claim 1, further comprising a fan positioned in a portion of the first duct in which the first duct changes direction, the fan being configured to direct a flow of the air guided by the first duct along the first duct.

15. The refrigerator as claimed in claim 1, wherein the at least one chamber includes a refrigerating chamber and the door is configured to open and close the refrigerating chamber.

16. The refrigerator as claimed in claim 1, further comprising a second duct configured to guide air cooled by the evaporator to the refrigerating chamber.

17. The refrigerator as claimed in claim 16, further comprising a third duct configured to pass through the at least one wall separating the freezing chamber from the refrigerating chamber to guide air from the cavity to the freezing chamber.

18. The refrigerator as claimed in claim 1, wherein the evaporator is a first evaporator, further comprising:

a second evaporator configured to regulate temperatures of the refrigerating chamber, wherein the first evaporator is configured to regulate temperatures of the freezing chamber and the first duct is configured to guide air that has been cooled by the first evaporator.

19. The refrigerator as claimed in claim 1, wherein the supplemental duct further includes a gasket provided at a point of connection between the first part and the second part when the door is in the closed position.

20. A refrigerator comprising:

a cabinet including one or more walls defining at least one chamber;

an evaporator positioned in the cabinet;

a door including one or more walls defining a cavity;

an interface on the door corresponding to the cavity and configured to receive air;

a first duct configured to guide air that has been cooled by the evaporator from the evaporator to an interface of the cabinet that corresponds to the interface on the door through which the cooled evaporator air is passed to enable regulation of a temperature associated with the cavity; and a supplemental duct configured to guide the cooled evaporator air to the freezing chamber, wherein the one or more walls defining at least one chamber include one or more walls defining a freezing chamber and a refrigerating chamber, at least one of the one or more walls separating the freezing chamber from the refrigerating chamber, and wherein the supplemental duct includes:

a first part included on the door; and a second part included on the sidewall of the cabinet, and the second part being configured to interface with the first part when the door is in a closed position.

21. A refrigerator comprising:

a cabinet including one or more walls defining a freezing chamber and a refrigerating chamber;

a refrigerator door configured to open and close to expose and cover at least a portion of the refrigerating chamber;

an evaporator positioned in the cabinet;

a first duct positioned in the cabinet and configured to guide air; and a second duct included on the refrigerator door and being configured to interface with the first duct when the door is in a closed positioned and being configured to be separated from the first duct when the door is in an open position, wherein the one or more walls defining the freezing chamber and the refrigerating chamber include at least one wall separating the freezing chamber from the refrigerating chamber, and wherein the first duct passes the at least one wall separating the freezing chamber from the refrigerating chamber.

22. The refrigerator as claimed in claim 21, wherein the second duct is configured to be connected to the first duct when the door is in the closed positioned and to be disconnected from the first duct when the door is in the open positioned.

23. The refrigerator as claimed in claim 21, further comprising:

an icemaker; and a dispenser positioned in the refrigerator door and configured to dispense ice produced by the icemaker.

24. The refrigerator as claimed in claim 23, wherein the first duct and the second duct are configured to guide air that has been cooled by the evaporator from the evaporator to the icemaker to enable regulation of a temperature of the icemaker when the refrigerator door is in the closed position.

25. The refrigerator as claimed in claim 21, wherein the evaporator is positioned in the refrigerating chamber.

26. The refrigerator as claimed in claim 21, wherein the evaporator is positioned in the freezing chamber.

27. The refrigerator as claimed in claim 21, further comprising a fan configured to promote movement of evaporator air between the first duct and the second duct.

28. The refrigerator as claimed in claim 21, wherein the fan is configured to stop when the refrigerator door is in the open position.

29. A refrigerator comprising:

a cabinet including one or more walls defining a freezing chamber and a refrigerating chamber, at least one wall separating the freezing chamber from the refrigerating chamber;

an evaporator positioned in the cabinet;

a refrigerator door configured to open and close to expose and cover at least a portion of the refrigerating chamber;

an icemaker;

an ice container positioned on the refrigerator door and configured to store ice made by the icemaker;

a structure provided on the refrigerator door and corresponding to the ice container, the structure including an inlet configured to receive air;

a first duct configured to guide air that has been cooled by the evaporator and to enable regulation of a temperature associated with the icemaker, the first duct configured to guide air to an outlet configured to connect to the inlet of the structure provided on the refrigerator door when the refrigerator door is in a closed position; and a second duct configured to provide a return path for the evaporator cooled air to the freezing chamber.

30. The refrigerator as claimed in claim 29, wherein the evaporator is positioned in the freezing chamber and the first duct penetrates the at least one wall separating the freezing chamber and the refrigerating chamber.

31. The refrigerator as claimed in claim 29, wherein the evaporator is positioned in the refrigerating chamber.

32. The refrigerator as claimed in claim 29, wherein the outlet of the first duct is configured to be separated from the inlet when the refrigerator door is in an open position.

33. The refrigerator as claimed in claim 29, wherein the inlet of the structure provided on the refrigerator door includes an inlet of a third duct.

34. The refrigerator as claimed in claim 29, wherein the inlet of the structure provided on the refrigerator door includes an inlet of a structure defining a cavity in which the ice container is positioned.

35. The refrigerator as claimed in claim 29, further comprising a dispenser positioned in the refrigerator door, the dispenser being configured to dispense ice made by the icemaker.

36. A refrigerator comprising:

a cabinet;

a refrigerating compartment defined at a first portion of the cabinet;

a freezing compartment defined at a second portion of the cabinet that is different than the first portion of the cabinet, the refrigerating compartment and the freezing compartment being configured to maintain temperatures that differ, with the freezing compartment having a freezing temperature that is lower than a refrigerating temperature of the refrigerating compartment;

a refrigerator door that is configured to open and close at least a portion of the refrigerating compartment;

an outlet defined in a wall of the refrigerating compartment;

a duct configured to guide air cooled to a freezing temperature from an area of the refrigerator corresponding to the freezing compartment to the outlet defined in the wall of the refrigerating compartment;

an ice compartment positioned on the refrigerator door and defined by at least one insulating wall;

an icemaker;

an ice container positioned in the ice compartment and configured to store ice made by the icemaker;

an inlet that is defined in an insulating wall of the ice compartment, that is configured to interface with the outlet defined in the wall of the refrigerating compartment when the refrigerator door is oriented in a closed positioned, that is configured to be separated from the outlet defined in the wall of the refrigerating compartment when the refrigerator door is oriented in an open position, and that is configured to receive air guided by the duct when the inlet interfaces with the outlet defined in the wall of the refrigerating compartment, the air received by the inlet being delivered to the ice compartment such that the ice compartment is maintained at a freezing temperature and ice stored in the ice container is maintained in a frozen state;

a dispenser that is positioned on the refrigerator door and that is configured to dispense ice through the refrigerator door when the refrigerator door is oriented in the closed position; and an ice chute positioned on the refrigerator door and configured to guide ice stored in the ice container to the dispenser.

37. The refrigerator of claim 36 wherein the duct extends from the freezing compartment to the outlet defined in the wall of the refrigerating compartment.

38. The refrigerator of claim 36 wherein the outlet is defined in a side wall of the refrigerating compartment.

39. The refrigerator of claim 36 wherein the ice chute connects the ice compartment with the dispenser.

40. The refrigerator of claim 36 further comprising a damper configured to open and close an opening defined in an insulating wall of the ice compartment.

41. The refrigerator of claim 36 further comprising a second duct configured to provide a return path for the air received by the inlet to the freezing compartment.

42. The refrigerator as claimed in claim 21, wherein the first duct and the second duct are configured to guide air from the refrigerator door to the freezing chamber.

43. The refrigerator as claimed in claim 21, wherein the first duct passes through the at least one wall separating the freezing chamber from the refrigerating chamber.

44. The refrigerator as claimed in claim 21, wherein the first duct penetrates the at least one wall separating the freezing chamber from the refrigerating chamber.

45. The refrigerator as claimed in claim 21, wherein the first duct is positioned along a sidewall of the cabinet.

46. A refrigerator comprising:

a cabinet;

a refrigerating compartment defined at a first portion of the cabinet;

a freezing compartment defined at a second portion of the cabinet that is different than the first portion of the cabinet, the refrigerating compartment and the freezing compartment being configured to maintain temperatures that differ, with the freezing compartment having a freezing temperature that is lower than a refrigerating temperature of the refrigerating compartment;

a refrigerator door that is configured to open and close at least a portion of the refrigerating compartment;

an inlet defined in a wall of the refrigerating compartment;

a duct configured to guide air from the inlet defined in the wall of the refrigerating compartment to an area of the refrigerator corresponding to the freezing compartment;

an ice compartment positioned on the refrigerator door and defined by at least one insulating wall;

an icemaker;

an ice container positioned in the ice compartment and configured to store ice made by the icemaker;

an outlet that is defined in an insulating wall of the ice compartment, that is configured to interface with the inlet defined in the wall of the refrigerating compartment when the refrigerator door is oriented in a closed positioned, that is configured to be separated from the inlet defined in the wall of the refrigerating compartment when the refrigerator door is oriented in an open position, and that is configured to guide air from the ice compartment to the duct when the outlet interfaces with the inlet defined in the wall of the refrigerating compartment;

a dispenser that is positioned on the refrigerator door and that is configured to dispense ice through the refrigerator door when the refrigerator door is oriented in the closed position; and an ice chute positioned on the refrigerator door and configured to guide ice stored in the ice container to the dispenser.

47. The refrigerator of claim 46 wherein the duct extends from the inlet defined in the wall of the refrigerating compartment to the freezing compartment.

48. The refrigerator of claim 46 wherein the inlet is defined in a side wall of the refrigerating compartment.

49. The refrigerator of claim 46 wherein the duct is configured to provide a return path for air received by the inlet to the freezing compartment.

* * * * *

US007703298C1

(12) INTER PARTES REEXAMINATION CERTIFICATE (940th)

United States Patent
Lee et al.

(10) Number: US 7,703,298 C1
(45) Certificate Issued: Aug. 21, 2014

(54) REFRIGERATOR WITH ICEMAKER

(75) Inventors: Myung Ryul Lee, Sungnam-si (KR); Seong Jae Kim, Ansan-si (KR); Chang Ho Seo, Seoul (KR); Sung Hoon Chung, Seoul (KR)

(73) Assignee: LG Electronics Inc., Yoido-Dong, Youngdungpo-gu, Seoul (KR)

Reexamination Request:
No. 95/001,901, Feb. 21, 2012

Reexamination Certificate for:

| | |
|---|---|
| Patent No.: | **7,703,298** |
| Issued: | **Apr. 27, 2010** |
| Appl. No.: | **12/104,268** |
| Filed: | **Apr. 16, 2008** |

Related U.S. Application Data

(63) Continuation of application No. 11/739,291, filed on Apr. 24, 2007, now Pat. No. 7,392,665, and a continuation of application No. 11/402,818, filed on Apr. 13, 2006, now Pat. No. 7,222,498, and a continuation of application No. 10/769,814, filed on Feb. 3, 2004, now Pat. No. 7,076,967.

(30) Foreign Application Priority Data

Sep. 19, 2003 (KR) ..... 10-2003-0065163

(51) Int. Cl.
*F25C 5/14* (2006.01)

(52) U.S. Cl.
USPC ..... 62/344; 62/419

(58) Field of Classification Search
None
See application file for complete search history.

(56) References Cited

To view the complete listing of prior art documents cited during the proceeding for Reexamination Control Number 95/001,901, please refer to the USPTO's public Patent Application Information Retrieval (PAIR) system under the Display References tab.

*Primary Examiner* — Sara Clarke

(57) ABSTRACT

Refrigerator with an icemaker including a cabinet having a mullion wall for compartmentalization of a freezing chamber and a refrigerating chamber, a case provided to a door on the refrigerating chamber, having a cavity therein, a first duct for supplying cold air from a neighborhood of an evaporator in the freezing chamber to the cavity, the icemaker in the cavity for producing ice, an ice container in the cavity for storing the ice, and a dispenser in the door in communication with the cavity, thereby having ice supplied to a user at an outside of the refrigerator through a dispenser provided to the door.

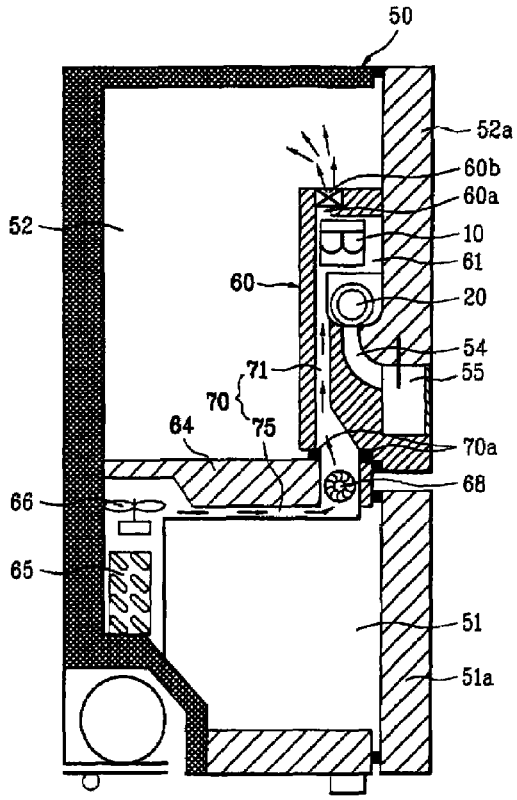

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 29, 36-40 and 46 is confirmed.

Claim 21 is cancelled.

Claims 22-28 and 42-45 are determined to be patentable as amended.

New claims 50-105 are added and determined to be patentable.

Claims 1-20, 30-35, 41 and 47-49 were not reexamined.

22. The refrigerator as claimed in claim [21] *23*, wherein the second duct is configured to be connected to the first duct when the door is in the closed [positioned] *position* and to be disconnected from the first duct when the door is in the open [positioned] *position*.

23. [The refrigerator as claimed in claim 21, further comprising:] *A refrigerator comprising:*

*a cabinet including one or more walls defining a freezing chamber and a refrigerating chamber, wherein the freezing chamber is located below the refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber;* an icemaker; and a dispenser positioned in the refrigerator door and configured to dispense ice produced by the icemaker.

24. [The refrigerator as claimed in claim 23,] *A refrigerator comprising:*

*a cabinet including one or more walls defining a freezing chamber and a refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber;*

*an icemaker;*

*a dispenser positioned in the refrigerator door and configured to dispense ice produced by the icemaker; and* wherein the first duct and the second duct are configured to guide air has that been cooled by the evaporator from the evaporator to the icemaker to enable regulation of a temperature of the icemaker when the refrigerator door is in the closed position.

25. The refrigerator as claimed in claim [21] *23*, wherein the evaporator is positioned in the refrigerating chamber.

26. The refrigerator as claimed in claim [21] *23*, wherein the evaporator is positioned in the freezing chamber.

27. The refrigerator as claimed in claim [21] *23*, further comprising a fan configured to promote movement of evaporator air between the first duct and the second duct.

28. The refrigerator as claimed in claim [21] *27*, wherein the fan is configured to stop when the refrigerator door is in the open position.

42. [The refrigerator as claimed in claim 21,] *A refrigerator comprising:*

*a cabinet including one or more walls defining a freezing chamber and a refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber; and* wherein the first duct and the second duct are configured to guide air from the refrigerator door to the freezing chamber.

43. The refrigerator as claimed in claim [21] *23*, wherein the first duct passes through the at least one wall separating the freezing chamber from the refrigerating chamber.

44. The refrigerator as claimed in claim [21] *23*, wherein the first duct penetrates the at least one wall separating the freezing chamber from the refrigerating chamber.

45. [The refrigerator as claimed in claim 21,] *A refrigerator comprising:*

*a cabinet including one or more walls defining a freezing chamber and a refrigerating chamber, wherein the freezing chamber is located below the refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber, and* wherein the first duct is positioned along a sidewall of the cabinet.

*50. The refrigerator as claimed in claim 53, further comprising an icemaker in the refrigerating chamber.*

*51. The refrigerator as claimed in claim 23, wherein the second duct includes an air flow regulator configured to regulate air flow passing through the second duct.*

*52. A refrigerator comprising:*

*a cabinet including one or more walls defining a freezing chamber and a refrigerating chamber, wherein the freezing chamber is located below the refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber, and*

*wherein one of an icemaker and an ice container is exposed to air flowing from the second duct.*

*53. A refrigerator comprising:*

*a cabinet including one or more walls defining a freezing chamber and a refrigerating chamber, wherein the freezing chamber is located below the refrigerating chamber;*

*a refrigerator door configured to open and close to expose and cover at least a portion of the refrigerating chamber;*

*an evaporator positioned in the cabinet;*

*a first duct positioned in the cabinet and configured to guide air; and*

*a second duct included on the refrigerator door and being configured to interface with the first duct when the door is in a closed position and being configured to be separated from the first duct when the door is in an open position,*

*wherein the one or more walls defining the freezing chamber and the refrigerating chamber include at least one wall separating the freezing chamber from the refrigerating chamber;*

*wherein the first duct passes the at least one wall separating the freezing chamber from the refrigerating chamber; and*

*wherein the refrigerator door comprises a first refrigerator door and a second refrigerator door.*

*54. The refrigerator as claimed in claim 53, further comprising an icemaker disposed on the first refrigerator door.*

*55. The refrigerator as claimed in claim 53, wherein the first refrigerator door includes an ice container for storing ice.*

*56. The refrigerator as claimed in claim 54, wherein the icemaker is positioned at a height above an ice storage bin.*

*57. The refrigerator as claimed in claim 55, further comprising a dispenser positioned in the first refrigerator door, wherein the dispenser is configured to communicate with the ice container.*

*58. The refrigerator as claimed in claim 57, further comprising an ice chute between the ice container and the dispenser, wherein the ice chute is configured to guide ice from the ice container to the dispenser.*

*59. The refrigerator as claimed in claim 58, further comprising a control panel on an outside surface of the refrigerator door for controlling the dispenser.*

*60. The refrigerator as claimed in claim 24, wherein the freezing chamber includes a space for the evaporator.*

*61. The refrigerator as claimed in claim 55, wherein the icemaker is positioned in an upper part of the first refrigerator door and the ice container is positioned in a lower part of the first refrigerator door.*

*62. The refrigerator as claimed in claim 55, wherein the ice container is disposed within a cavity of the first refrigerator door.*

*63. The refrigerator as claimed in claim 62, wherein the cavity is formed of insulating material for preventing heat exchange between the refrigerating chamber and the cavity.*

*64. The refrigerator as claimed in claim 63, wherein a portion of the cavity is configured to communicate with a dispenser in the first refrigerator door via an ice chute.*

*65. The refrigerator as claimed in claim 23, wherein the freezing chamber includes a space for the evaporator.*

*66. The refrigerator as claimed in claim 36, wherein the freezing compartment is located below the refrigerating compartment.*

*67. The refrigerator as claimed in claim 66, wherein the refrigerator door comprises a first refrigerating door and a second refrigerating door and wherein the ice compartment is disposed on the first refrigerating door.*

*68. The refrigerator as claimed in claim 66, wherein the icemaker is positioned in the ice compartment.*

*69. The refrigerator as claimed in claim 66, wherein the inlet that is defined in the insulating wall of the ice compartment is formed on a side wall of the ice compartment.*

*70. The refrigerator as claimed in claim 66, wherein the inlet that is defined in the insulating wall of the ice compartment is formed at a lower end of the ice compartment.*

*71. The refrigerator as claimed in claim 66, further comprising a second duct configured to supply cooled air to a rear portion of the refrigerating compartment, and the ice compartment haying an opening configured to communicate with a front portion of the refrigerating compartment.*

*72. The ice compartment as claimed in claim 71, further comprising a damper configured to open and close the opening in an insulating wall of the ice compartment.*

*73. The refrigerator as claimed in claim 66, wherein the duct includes a bent portion located in the freezing compartment and a fan positioned in the duct for blowing the cooled air.*

*74. The refrigerator as claimed in claim 73, wherein the fan is positioned along the bent portion.*

*75. The refrigerator as claimed in claim 66, wherein the duct includes a bent portion located at a mullion wall separating the freezing compartment and the refrigerating compartment and a fan positioned in the duct for blowing the cooled air.*

*76. The refrigerator as claimed in claim 75, wherein the fan is positioned along the bent portion.*

*77. The refrigerator as claimed in claim 29, further comprising a third duct configured to supply air that has been cooled by the evaporator to a rear portion of the refrigerating chamber, and the structure having an opening configured to communicate with a front portion of the refrigerating chamber.*

*78. The refrigerator as claimed in claim 29, wherein the regulation of the temperature of the icemaker is such that the icemaker produces ice pieces by using the air that has been cooled by the evaporator and the ice pieces are stored in the ice container.*

*79. The refrigerator as claimed in claim 29, further comprising a gasket on the inlet to sealingly communicate with the outlet when the refrigerator door is closed.*

*80. The refrigerator as claimed in claim 29, wherein the icemaker is positioned on the refrigerator door above the ice container.*

*81. The refrigerator as claimed in claim 29, further comprising:*

*an ice dispenser on the refrigerator door;*

*an ice chute configured to communicate the ice container and the ice dispenser; and*

*a third duct configured to guide at least a portion of the evaporator cooled air to a rear portion of the refrigerating chamber.*

*82. The refrigerator as claimed in claim 81, further comprising a transfer mechanism within the ice container to transfer ice in the ice container toward the ice chute.*

*83. The refrigerator as claimed in claim 82, wherein the transfer mechanism is connected to a motor and is rotated to transfer ice within the ice container.*

*84. The refrigerator as claimed in claim 46, wherein the outlet has a first end on the refrigerating door configured to communicate with the inlet defined in a wall of the refrigerating compartment and a second end configured to communicate with the ice compartment, and wherein the first end includes a gasket to form a seal when communicating with inlet defined in a wall of the refrigerating compartment when the refrigerator door is closed.*

*85. The refrigerator as claimed in claim 46, further comprising a second duct configured to guide air from an area of the refrigerator corresponding to the freezing compartment to a rear portion of the refrigerating compartment, and the ice compartment having an opening configured to communicate with a front portion of the refrigerating compartment.*

*86. The refrigerator as claimed in claim 46, further comprising:*

*an evaporator;*

*a second duct configured to guide air, cooled by the evaporator, to the ice compartment, the second duct comprising*

*a first part provided in the refrigerator door in communication with the ice compartment, wherein the first part of the second duct supplies the cooled air to the ice compartment; and*

*a second part provided in the cabinet configured to communicate with the first part when the refrigerator door is closed.*

*87. The refrigerator as claimed in claim 86, wherein the second part of the second duct provided in the cabinet is configured to communicate with the freezing compartment, and the first part of the second duct is configured to communicate with the second part of the second and form a seal when the refrigerator door is closed.*

*88. The refrigerator as claimed in claim 86, wherein the first part of the second duct provided on the refrigerator door is configured to communicate with a side wall of the ice compartment, and the second part of the second duct is provided along with a side wall of the cabinet and is configured to communicate with the first part of the second duct when the refrigerator door is closed.*

*89. The refrigerator as claimed in claim 85, further comprising a gasket on the first part to sealingly communicate with the second part when the refrigerator door is closed.*

*90. The refrigerator as claimed in claim 86, wherein the second duct further comprises a bent portion in the cabinet, and a fan positioned along the bent portion, for blowing cooled air.*

*91. The refrigerator as claimed in claim 86, wherein the first duct further comprises a bent portion in the cabinet, wherein the bent portion is located at a mullion wall separating the freezing chamber from the refrigerating chamber.*

*92. The refrigerator as claimed in claim 86,*

*wherein the icemaker is positioned in the ice compartment, and*

*wherein the first part of the second duct supplies the cooled air to at least one of the icemaker and the ice container such that the icemaker produces ice pieces by using the cooled air and the ice pieces are stored in the ice container.*

*93. The refrigerator as claimed in claim 46, further comprising a transfer mechanism within the ice container to transfer ice in the ice container toward the ice chute.*

*94. The refrigerator as claimed in claim 93, wherein the transfer mechanism is connected to a motor and is rotated to transfer ice within the ice container.*

*95. The refrigerator as claimed in claim 94, wherein the ice container includes a crusher to crush ice.*

*96. The refrigerator as claimed in claim 95, further comprising a user-operated control panel on the outside surface of the refrigerator door, such that a user can select crushed or uncrushed ice to be supplied through the dispenser.*

*97. The refrigerator as claimed in claim 94, wherein the ice compartment includes a crusher to crush ice.*

*98. The refrigerator as claimed in claim 36, wherein the ice compartment includes a crusher to crush ice.*

*99. The refrigerator as claimed in claim 98, further comprising a user-operated control panel on the outside surface of the refrigerator door, such that a user can select crushed or uncrushed ice to be supplied through the dispenser.*

*100. The refrigerator as claimed in claim 36, wherein the ice container includes a crusher to crush ice.*

*101. The refrigerator as claimed in claim 100, further comprising a user-operated control panel on the outside surface of the refrigerator door, such that a user can select to be supplied crushed or uncrushed ice through the dispenser.*

*102. The refrigerator as claimed in claim 24, wherein the icemaker is in the refrigerating chamber.*

*103. The refrigerator as claimed in claim 24, wherein the second duct includes an air flow regulator configured to regulate air flow passing through the second duct.*

*104. The refrigerator as claimed in claim 24, further comprising an ice container, wherein the ice container includes a crusher to crush ice.*

*105. The refrigerator as claimed in claim 24, further comprising a user-operated control panel on the outside surface of the refrigerator door, such that a user can select crushed or uncrushed ice to be supplied through the dispenser.*

* * * * *